United States Patent [19]

Kubo et al.

[11] Patent Number: 4,720,434

[45] Date of Patent: Jan. 19, 1988

[54] COMPOSITE MATERIAL INCLUDING SILICON CARBIDE AND/OR SILICON NITRIDE SHORT FIBERS AS REINFORCING MATERIAL AND ALUMINUM ALLOY WITH COPPER AND RELATIVELY SMALL AMOUNT OF SILICON AS MATRIX METAL

[75] Inventors: Masahiro Kubo; Tadashi Dohnomoto; Atsuo Tanaka, all of Toyota; Hidetoshi Hirai, Kariya, all of Japan

[73] Assignee: Toyota Jidosha Kabushiki Kaisha, Toyota, Japan

[21] Appl. No.: 901,196

[22] Filed: Aug. 28, 1986

[30] Foreign Application Priority Data

Sep. 2, 1985 [JP] Japan ..... 60-193416

[51] Int. Cl.[4] ..... B22F 3/26

[52] U.S. Cl. ..... 428/567; 428/404; 420/537; 420/548; 148/416; 148/438

[58] Field of Search ..... 428/567, 404; 420/537, 420/548; 148/416, 438

[56] References Cited

U.S. PATENT DOCUMENTS

| | | | |
|---|---|---|---|
| 3,180,727 | 4/1965 | Alexander et al. | 148/416 |
| 3,492,119 | 1/1970 | Rosenberg | 148/438 |
| 3,600,163 | 8/1971 | Badia et al. | 420/537 |
| 4,152,149 | 5/1979 | Horikiri et al. | 148/438 |

*Primary Examiner*—George F. Lesmes
*Assistant Examiner*—S. A. Gibson
*Attorney, Agent, or Firm*—Oblon, Fisher, Spivak, McClelland & Maier

[57] ABSTRACT

A composite material is made from silicon carbide and/or silicon nitride short fibers embedded in a matrix of metal. The metal is an alloy consisting essentially of between approximately 2% to approximately 6% of copper, between approximately 0.5% to approximately 3% of silicon, and remainder substantially aluminum. The short fibers may be all silicon carbide short fibers, or may be all silicon nitride short fibers, or may be a mixture of silicon carbide and silicon nitride short fibers. The fiber volume proportion of the silicon carbide and/or silicon nitride short fibers may desirably be between approximately 5% and approximately 50%, and may more desirably be between approximately 5% and approximately 40%.

6 Claims, 20 Drawing Figures

(30% VOLUME PROPORTION SILICON CARBIDE WHISKER TYPE SHORT FIBERS)

(40% VOLUME PROPORTION SILICON CARBIDE NON CONTINUOUS FIBERS)

( 20% VOLUME PROPORTION SILICON CARBIDE NON CONTINUOUS FIBERS )

COMPOSITE MATERIAL INCLUDING SILICON CARBIDE AND/OR SILICON NITRIDE SHORT FIBERS AS REINFORCING MATERIAL AND ALUMINUM ALLOY WITH COPPER AND RELATIVELY SMALL AMOUNT OF SILICON AS MATRIX METAL

BACKGROUND OF THE INVENTION

The present invention relates to a composite material made up from reinforcing fibers embedded in a matrix of metal, and more particularly relates to such a composite material utilizing silicon carbide or silicon nitride short fiber material, or a composite reinforcing fiber material made thereof, as the reinforcing fiber material, and aluminum alloy as the matrix metal.

The present invention has been described in Japanese Patent Application Serial No. 60-193416 (1985), filed by an applicant the same as the entity assigned or owed duty of assignment of the present patent application; and the present patent application hereby incorporates into itself by reference the texts of said Japanese Patent Application and the claims and the drawings thereof; a copy is appended to the present application.

In the prior art, the following aluminum alloys of the cast type and of the wrought type have been utilized as matrix metal for a composite material:

Cast type aluminum alloys

JIS standard AC8A (from about 0.8% to about 1.3% Cu, from about 11.0% to about 13.0% Si, from about 0.7% to about 1.3% Mg, from about 0.8% to about 1.5% Ni, remainder substantially Al)

JIS standard AC8B (from about 2.0% to about 4.0% Cu, from about 8.5% to about 10.5% Si, from about 0.5% to about 1.5% Mg, from about 0.1% to about 1% Ni, remainder substantially Al)

JIS standard AC4C (Not more than about 0.25% Cu, from about 6.5% to about 7.5% Si, from about 0.25% to about 0.45% Mg, remainder substantially Al)

AA standard A201 (from about 4% to about 5% Cu, from about 0.2% to about 0.4% Mn, from about 0.15% to about 0.35% Mg, from about 0.15% to about 0.35% Ti, remainder substantially Al)

AA standard A356 (from about 6.5% to about 7.5% Si, from about 0.25% to about 0.45% Mg, not more than about 0.2% Fe, not more than about 0.2% Cu, remainder substantially Al)

Al—from about 2% to about 3% Li alloy (DuPont)

Wrought type aluminum alloys

JIS standard 6061 (from about 0.4% to about 0.8% Si, from about 0.15% to about 0.4% Cu, from about 0.8% to about 1.2% Mg, from about 0.04% to about 0.35% Cr, remainder substantially Al)

JIS standard 5056 (not more than about 0.3% Si, not more than about 0.4% Fe, not more than about 0.1% Cu, from about 0.05% to about 0.2% Mn, from about 4.5% to about 5.6% Mg, from about 0.05% to about 0.2% Cr, not more than about 0.1% Zn, remainder substantially Al)

JIS standard 2024 (about 0.5% Si, about 0.5% Fe, from about 3.8% to about 4.9% Cu, from about 0.3% to about 0.9% Mn, from about 1.2% to about 1.8% Mg, not more than about 0.1% Cr, not more than about 0.25% Zn, not more than about 0.15% Ti, remainder substantially Al)

JIS standard 7075 (not more than about 0.4% Si, not more than about 0.5% Fe, from about 1.2% to about 2.0% Cu, not more than about 3.0% Mn, from about 2.1% to about 2.9% Mg, from about 0.18% to about 0.28% Cr, from about 5.1% to about 6.1% Zn, about 0.2% Ti, remainder substantially Al)

Previous research relating to composite materials incorporating aluminum alloys as their matrix metals has generally been carried out from the point of view and with the object of improving the strength and so forth of existing aluminum alloys, and therefore these aluminum alloys conventionally used in the manufacture of such prior art composite materials have not necessarily been of the optimum composition in relation to the type of reinforcing fibers utilized therewith to form a composite material, and therefore, in the case of using such conventional above mentioned aluminum alloys as the matrix metal for a composite material, it has not heretofore been attained to optimize the mechanical characteristics, and particularly the strength, of the composite materials using such aluminum alloys as matrix metal.

SUMMARY OF THE INVENTION

The inventors of the present application have considered the above mentioned problems in composite materials which use such conventional aluminum alloys as matrix metal, and in particular have considered the particular case of a composite material which utilizes silicon carbide short fibers or silicon nitride short fibers as reinforcing fibers, since such silicon carbide or silicon nitride short fibers, among the various reinforcing fibers used conventionally in the manufacture of a fiber reinforced metal composite material, have particularly high strength, and are exceedingly effective in improving the high temperature stability and strength. And the present inventors, as a result of various experimental researches to determine what composition of the aluminum alloy to be used as the matrix metal for such a composite material is optimum, have discovered that an aluminum alloy having a content of copper and a content of silicon within certain limits, and containing substantially no magnesium, nickel, zinc, and so forth is optimal as matrix metal, particularly in view of the bending strength characteristics of the resulting composite material. The present invention is based on the knowledge obtained from the results of the various experimental researches carried out by the inventors of the present application, as will be detailed later in this specification.

Accordingly, it is the primary object of the present invention to provide a composite material utilizing silicon carbide short fibers or silicon nitride short fibers as reinforcing material and aluminum alloy as matrix metal, which enjoys superior mechanical characteristics such as bending strength.

It is a further object of the present invention to provide such a composite material utilizing silicon carbide short fibers or silicon nitride short fibers as reinforcing material and aluminum alloy as matrix metal, which is cheap.

It is a further object of the present invention to provide such a composite material utilizing silicon carbide short fibers or silicon nitride short fibers as reinforcing material and aluminum alloy as matrix metal, which, for similar values of mechanical characteristics such as bending strength, can incorporate a lower volume proportion of reinforcing fiber material than prior art such composite materials.

It is a further object of the present invention to provide such a composite material utilizing silicon carbide short fibers or silicon nitride short fibers as reinforcing material and aluminum alloy as matrix metal, which is improved over prior art such composite materials as regards machinability.

It is a further object of the present invention to provide such a composite material utilizing silicon carbide short fibers or silicon nitride short fibers are reinforcing material and aluminum alloy as matrix metal, which is improved over prior art such composite materials as regards workability.

It is a further object of the present invention to provide such a composite material utilizing silicon carbide short fibers or silicon nitride short fibers as reinforcing material and aluminum alloy as matrix metal, which has good characteristics with regard to amount of wear on a mating member.

It is a yet further object of the present invention to provide such a composite material utilizing silicon carbide short fibers or silicon nitride short fibers as reinforcing material and aluminum alloy as matrix metal, which is not brittle.

It is a yet further object of the present invention to provide such a composite material utilizing silicon carbide short fibers as reinforcing material and aluminum alloy as matrix metal, which is durable.

It is a yet further object of the present invention to provide such a composite material utilizing silicon carbide short fibers or silicon nitride short fibers are reinforcing material and aluminum alloy as matrix metal, which has good wear resistance.

It is a yet further object of the present invention to provide such a composite material utilizing silicon carbide short fibers or silicon nitride short fibers as reinforcing material and aluminum alloy as matrix metal, which has good uniformity.

According to the most general aspect of the present invention, these and other objects are attained by a composite material, comprising short fibers, the material of each one of which is selected from the class made up of silicon carbide and silicon nitride, embedded in a matrix of metal, said metal being an alloy consisting essentially of between approximately 2% to approximately 6% of copper, between approximately 0.5% to approximately 3% of silicon, and remainder substantially aluminum. Preferably, the fiber volume proportion of said silicon carbide short fibers may be between approximately 5% and approximately 50%; and more preferably the fiber volume proportion of said silicon carbide short fibers may be between approximately 5% and approximately 40%. The short fibers may be substantially all composed of silicon carbide; or, alternatively, substantially all said short fibers may be composed of silicon nitride; or, alternatively, a substantial proportion of said short fibers may be composed of silicon carbide while also substantial proportion of said short fibers are composed of silicon nitride.

According to the present invention as described above, as reinforcing fibers there are used silicon carbide short fibers or silicon nitride short fibers which have high strength, and are exceedingly effective in improving the high temperature stability and strength of the resulting composite material, and as matrix metal there is used an aluminum alloy with a copper content of from approximately 2% to approximately 6%, a silicon content of from approximately 0% to approximately 2%, and the remainder substantially aluminum, and the volume proportion of the silicon carbide short fibers or the silicon nitride short fibers is desirably from approximately 5% to approximately 50%, whereby, as is clear from the results of experimental research carried out by the inventors of the present application as will be described below, a composite material with superior mechanical characteristics such as strength can be obtained.

Also according to the present invention, in cases where it is satisfactory if the same degree of strength as a conventional silicon carbide or silicon nitride short fiber reinforced aluminum alloy is obtained, the volume proportion of silicon carbide short fibers or silicon nitride short fibers in a composite material according to the present invention may be set to be lower than the value required for such a conventional composite material, and therefore, since it is possible to reduce the amount of silicon carbide short fibers used, the machinability and workability of the composite material can be improved, and it is also possible to reduce the cost of the composite material. Further, the characteristics with regard to wear on a mating member will be improved.

As will become clear from the experimental results detailed hereinafter, when copper is added to aluminum to make the matrix metal of the composite material according to the present invention, the strength of the aluminum alloy matrix metal is increased and thereby the strength of the composite material is improved, but that effect is not sufficient if the copper content is less than 2%, whereas if the copper content is more than 6% the composite material becomes very brittle, and has a tendency rapidly to disintegrate. Therefore the copper content of the aluminum alloy used as matrix metal in the composite material of the present invention is required to be in the range of from approximately 2% to approximately 6%. Furthermore, as will also become clear from the experimental results detailed hereinafter, with regard to the silicon which as specified above is to be added to the aluminum to make the matrix metal of the composite material according to the present invention, the strength of the aluminum alloy matrix metal is thereby increased and thereby the strength of the composite material is improved, but that effect is not sufficient if the silicon content is less than 0.5%, whereas if the silicon content is more than 3% the composite material becomes very brittle, and has a tendency rapidly to disintegrate. Therefore the silicon content of the aluminum alloy used as matrix metal in the composite material of the present invention is required to be in the range of from approximately 0.5% to approximately 3%.

Furthermore, in a composite material with an aluminum alloy of the above composition as matrix metal, as also will become clear from the experimental researches given hereinafter, if the volume proportion of the silicon carbide or silicon nitride short fibers is less than 5%, a sufficient strength cannot be obtained, and if the volume proportion of the silicon carbide or silicon nitride short fibers exceeds 40% and particularly if it exceeds 50% even if the volume proportion of the silicon carbide or silicon nitride short fibers is increased, the strength of the composite material is not very significantly improved. Also, the wear resistance of the composite material increases with the volume proportion of the silicon carbide or silicon nitride short fibers, but when the volume proportion of the silicon carbide short fibers is in the range from zero to approximately 5% said wear resistance increases rapidly with an increase in the volume proportion of the silicon carbide or silicon nitride short fibers, whereas when the volume proportion of the silicon carbide or silicon nitride short fibers is in the range of at least approximately 5%, the wear resistance of the composite material does not very significantly increase with an increase in the volume proportion of said silicon carbide or silicon nitride short fibers. Therefore, according to one characteristic of the present invention, the volume proportion of the silicon carbide or silicon nitride short fibers is required to be in the range of from approximately 5% to approximately 50%, and preferably is required to be in the range of from approximately 5% to approximately 40%.

If, furthermore, the copper content of the silicon content of the aluminum alloy used as matrix metal of the composite material of the present invention has a relatively high value, if there are unevennesses in the concentration of the copper or the silicon within the aluminum alloy, the portions where the copper concentration is high will be brittle, and it will not therefore be possible to obtain a uniform matrix metal or a composite material of good and uniform quality. Therefore, according to another detailed characteristic of the present invention, in order that the concentration of copper and silicon within the aluminum alloy matrix metal should be uniform, such a composite material is subjected to liquidizing processing for from about 2 hours to about 8 hours at a temperature of from about 480° C. to about 520° C., and is preferably further subjected to aging processing for about 2 hours to about 8 hours at a temperature of from about 150° C. to 200° C., while on the other hand such a composite material of which the matrix metal is aluminum alloy of which the copper content is at least approximately 3.5% and is less than approximately 6% is subjected to liquidizing processing for from about 2 hours to about 8 hours at a temperature of from about 460° C. to about 510° C., and is preferably further subjected to aging processing for about 2 hours to about 8 hours at a temperature of from about 150° C. to 200° C.

Further, if silicon carbide short fibers are used in the composite material of the present invention, these silicon carbide short fibers may either be silicon carbide whiskers or silicon carbide non continuous fibers, and such silicon carbide non continuous fibers may be silicon carbide continuous fibers cut to a predetermined length. On the other hand, if silicon nitride short fibers are used in the composite material of the present invention, these silicon nitride short fibers similarly may be either silicon nitride whiskers or silicon nitride non continuous fibers, and such silicon nitride non continuous fibers may be silicon nitride continuous fibers cut to a predetermined length. Also, the fiber length of the silicon carbide or silicon nitride short fibers is preferably from approximately 10 microns to approximately 5 cm, and particularly is from approximately 50 microns to approximately 2 cm, and the fiber diameter is preferably approximately 0.1 micron to approximately 25 microns, and particularly is from approximately 0.1 micron to approximately 20 microns.

It should be noted that in this specification all percentages, except in the expression of volume proportion of reinforcing fiber material, are percentages by weight, and in expressions of the composition of an aluminum alloy, "substantially aluminum" means that, apart from aluminum, copper and silicon, the total of the inevitable metallic elements such as silicon, iron, zinc, manganese, nickel, titanium, and chromium included in the aluminum alloy used as matrix metal is not more than about 1%, and each of said elements individually is not present to more than about 0.5%. It should further be noted that, in this specification, in descriptions of ranges of compositions, temperatures and the like, the expressions "at least", "not less than", "at most", "no more than", and "from . . . to . . . " and so on are intended to include the boundary values of the respective ranges.

BRIEF DESCRIPTION OF THE DRAWINGS

The present invention will now be described with respect to the preferred embodiments thereof, and with reference to the illustrative drawings appended hereto, which however are provided for the purposes of explanation and exemplification only, and are not intended to be limitative of the scope of the present invention in any way, since this scope is to be delimited solely by the accompanying claims. With relation to the figures, spatial terms are to be understood as referring only to the orientation on the drawing paper of the illustrations of the relevant parts, unless otherwise specified; like reference numerals, unless otherwise so specified, denote the same parts and gaps and spaces and so on in the various figures relating to one preferred embodiment, and like parts and gaps and spaces and so on in the figures relating to different preferred embodiments; and:

DESCRIPTION OF THE PREFERRED EMBODIMENTS

The present invention will now be described with reference to the various preferred embodiments thereof. It should be noted that the table referred to in this specification is to be found at the end of the specification and before the claims thereof: the present specification is arranged in such a manner in order to maximize ease of pagination.

The First Set Of Preferred Embodiments

In order to assess what might be the most suitable composition for an aluminum alloy to be utilized as matrix metal for a contemplated composite material of the type described in the preamble to this specification, the reinforcing material of which is to be, in this case, silicon carbide short fibers, the present inventors manufactured by using the high pressure casting method samples of various composite materials, utilizing as reinforcing material silicon carbide whisker material of type "Tokamax" (this is a trademark) made by Tokai Carbon K.K., which had fiber lengths 50 to 200 microns and fiber diameters 0.2 to 0.5 microns, and utilizing as matrix metal Al-Cu-Si type aluminum alloys of various compositions. Then the present inventors conducted evaluations of the bending strength of the various resulting composite material sample pieces.

Figure 1:
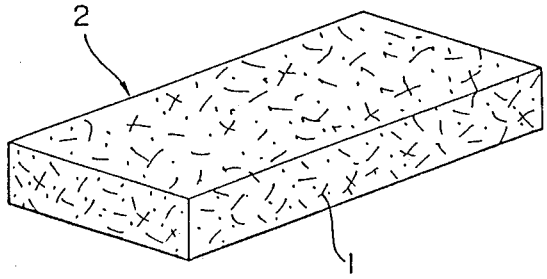
FIG. 1 is a perspective view of a preform made of silicon carbide or silicon nitride short whisker material, with said silicon carbide or silicon nitride short whiskers being aligned substantially randomly in three dimensions, for incorporation into composite materials according to various preferred embodiments of the present invention.

First, a set of aluminum alloys designated as A1 through A42 were produced, having as base material aluminum and having various quantities of silicon and copper mixed therewith, as shown in the appended Table; this was done by, in each case, introducing an appropriate quantity of substantially pure aluminum metal (purity at least 99%) and an appropriate quantity of alloy of approximately 50% aluminum and approximately 50% copper into a matrix alloy of approximately 75% aluminum and approximately 25% silicon. And an appropriate number of silicon carbide whisker material preforms were made by, in each case, subjecting a quantity of the above specified silicon carbide whisker material to compression forming without using any binder. Each of these silicon carbide whisker material preforms was, as schematically illustrated in perspective view in FIG. 1 wherein an exemplary such preform is designated by the refernce numeral 2 and the silicon carbide whiskers therein are generally designated as 1, about 38×100×16 mm in dimensions, and the individual silicon carbide whiskers 1 in said preform 2 were oriented substantially randomly in three dimensions. And the fiber volume proportion in each of said preforms 2 was approximately 30%.

Figure 2:
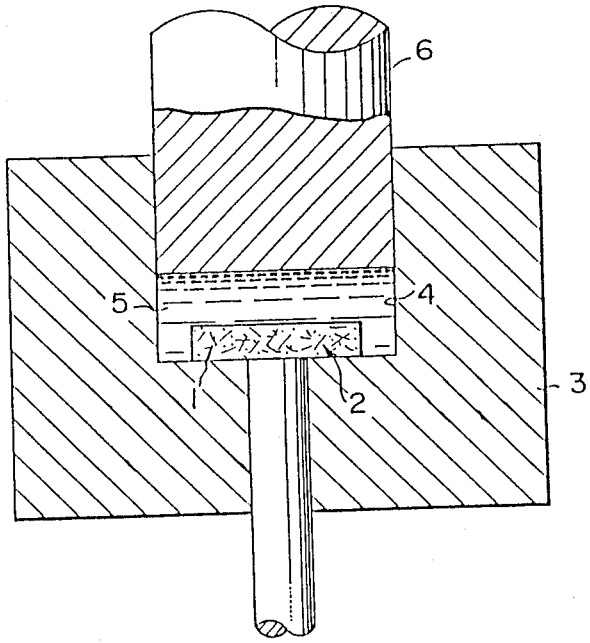
FIG. 2 is a schematic sectional diagram showing a high pressure casting device in the process of performing high pressure casting for manufacturing a composite material with the FIG. 1 silicon carbide or silicon nitride short whisker material preform incorporated in a matrix of matrix metal.

Next, each of these silicon carbide whisker material preforms 2 was subjected to high pressure casting together with an appropriate quantity of one of the aluminum alloys A1 through A42 described above, in the following manner. First, the preform 2 was heated up to a temperature of approximately 600° C., and then said preform 2 was placed within a mold cavity 4 of a casting mold 3, which itself had previously been preheated up to a temperature of approximately 250° C. Next, a quantity 5 of the appropriate one of the aluminum alloys A1 to A42 described above, molten and maintained at a temperature of approximately 710° C., was relatively rapidly poured into said mold cavity 4, so as to surround the preform 2 therein, and then as shown in schematic perspective view in FIG. 2 a pressure plunger 6, which itself had previously been preheated up to a temperature of approximately 200° C., and which closely cooperated with the upper portion of said mold cavity 4, was inserted into said upper mold cavity portion, and was pressed downwards by a means not shown in the figure so as to pressurize said to a pressure of approximately 1000 kg/cm$^2$. Thereby, the molten aluminum alloy was caused to percolate into the interstices of the silicon carbide whisker material preform 2. This pressurized state was maintained until the quantity 5 of molten aluminum alloy had completely solidified, and then the pressure plunger 6 was removed and the solidified aluminum alloy mass with the preform 2 included therein was removed from the casting mold 3, and the peripheral portion of said solidified aluminum alloy mass was machined away, leaving only a sample piece of composite material which had silicon carbide fiber whisker material as reinforcing material and the appropriate one of the aluminum alloys A1 through A42 as matrix metal. The volume proportion of silicon carbide fibers in each of the resulting composite material sample pieces was approximately 30%.

Next, the following post processing step were performed on the composite material samples. Irrespective of the silicon content of the aluminum alloy matrix metal: those of said composite material samples whose matrix metal had a copper content of less than approximately 2% were subjected to liquidizing processing at a temperature of approximately 530° C. for approximately 8 hours, and then were subjected to artificial aging processing at a temperature of approximately 160° C. for approximately 8 hours; those of said composite material samples whose matrix metal had a copper content of at least approximately 2% and not more than approximately 3.5% were subjected to liquidizing processing at a temperature of approximately 500° C. for approximately 8 hours, and then were subjected to artificial aging processing at a temperature of approximately 160° C. for approximately 8 hours; and those of said composite material samples whose matrix metal had a copper content of at least approximately 3.5% and not more than approximately 6.5% were subjected to liquidizing processing at a temperature of approximately 480° C. for approximately 8 hours, and then were subjected to artificial aging processing at a temperature of approximately 160° C. for approximately 8 hours.

From each of the composite material sample pieces manufactured as described above, to which heat treatment had been applied, there was cut a bending strength test piece of length approximately 50 mm, width approximately 10 mm, and thickness approximately 2 mm, and for each of these composite material bending strength test pieces a three point bending strength test was carried out, with a gap between supports of approximately 40 mm. In these bending strength tests, the bending strength of the composite material bending strength test piece was measured as the surface stress at breaking point M/Z (M is the bending moment at the breaking point, while Z is the cross section coefficient of the composite material bending strength test piece).

Figure 3:
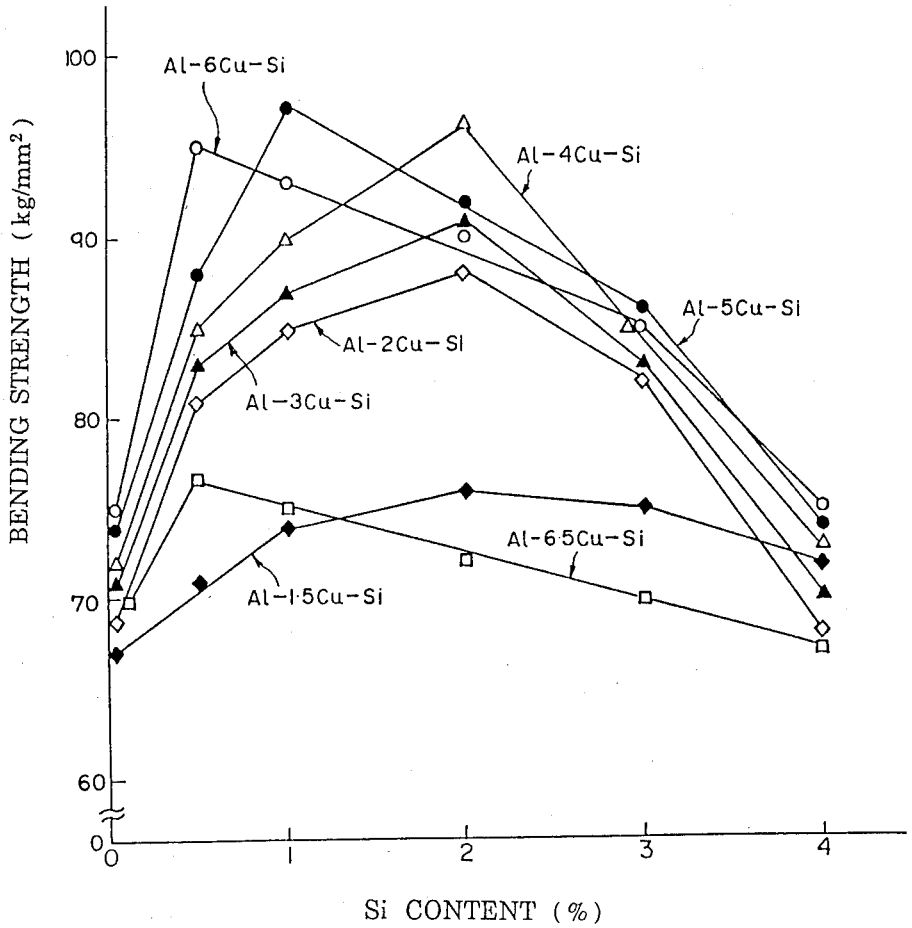
FIG. 3 is a set of graphs in which silicon content in percent is shown along the horizontal axis and bending strength in $kg/mm^2$ is shown along the vertical axis, derived from data relating to bending strength tests for the first set of preferred embodiments of the material of the present invention (in which the volume proportion of reinforcing silicon carbide whisker type short fiber material was approximately 30%), each said graph showing the relation between silicon content and bending strength of certain composite material test pieces for a particular fixed percentage copper content of in the matrix metal of the composite material.

The results of these bending strength tests were as shown and summarized in the line graphs of FIG. 3. Each of the line graphs of FIG. 3 shows the relation between silicon content (in percent) shown along the horizontal axis and the bending strength (in kg/mm$^2$) shown along the vertical axis of certain of the composite material test pieces having as matrix metals aluminum alloys with percentage content of silicon as shown along the horizontal axis and with percentage content of copper fixed along said line graph, and having as reinforcing material the silicon carbide fibers specified above.

From FIG. 3 it will be understood that, substantially irrespective of the silicon content of the aluminum alloy matrix metal of the bending strength composite material test pieces, when the copper content was either at the low extreme of approximately 1.5% or at the high extreme of approximately 6.5% the bending strength of the composite material had a relatively low value; and, contrariwise, when the copper content was between the more intermediate points of approximately 2% and approximately 6%, except in the extreme cases that the silicon content was approximately 0% or was approximately 4%, the bending strength of the composite material was considerably higher than when the copper content was either at the low extreme of approximately 1.5% or at the high extreme of approximately 6.5%. Accordingly, it will be understood that it is considered to be preferable for the copper content to be between approximately 2% and approximately 6%. Further, it will be seen that, when the silicon content was between the more intermediate points of approximately 0.5% to approximately 3%, except in the extreme cases that the copper content was approximately 1.5% or was approximately 6.5%, the bending strength of the composite material was significantly greater than when the silicon content was either at the low extreme of approximately 0% or at the high extreme of approximately 4%. And, particularly in the case that the copper content had a relatively low value within the range of approximately 2% to 4%, the bending strength of the composite material attained a substantially maximum value when the silicon content was approximately 2%. On the other hand, in the particular case that the copper content had a relatively high value within the range of approximately 5% to 6%, the bending strength of the composite material attained a substantially maximum value when the silicon content was between approximately 0.5% and approximately 1%. Accordingly, it will be understood that it is considered to be preferable for the silicon content to be between approximately 0.5% and approximately 3%.

It will be further seen that the values in FIG. 3 are generally much higher than the typical bending strength of approximately 60 kg/mm$^2$ attained in the conventional art for a composite material using as matrix metal a conventionally so utilized aluminum alloy of JIS standard AC4C and using a similar silicon carbide short fiber material as reinforcing material. Further, it will be seen that, for the particular above described types of such composite material having a volume proportion of approximately 30% of silicon carbide whisker material as reinforcing fiber material and using an aluminum alloy as matrix metal with a copper content of from approximately 2% to approximately 6% and with a silicon content of from approximately 0.5% to approximately 3%, the bending strength values are between approximately 1.4 and approximately 1.6 times the typical bending strength of approximately 60 kg/mm$^2$ attained by the above mentioned conventional composite material.

From the results of these bending strength tests it will be seen that, in order to provide for a good and appropriate bending strength for a composite material having as reinforcing fiber material silicon carbide whiskers in a volume proportion of approximately 30% and having as matrix metal an Al-Cu-Si type aluminum alloy, it is preferable that the copper content of said Al-Cu-Si type aluminum alloy matrix metal should be in the range of from approximately 2% to approximately 6% while the silicon content of said Al-Cu-Si type aluminum alloy matrix metal should be in the range of from approximately 0.5% to approximately 3%.

The Second Set Of Preferred Embodiments

Next, in order to assess what might be the most suitable composition for an aluminum alloy to be utilized as matrix metal for a contemplated composite material of the type described in the preamble to this specification, the reinforcing material of which is to be, in this next case, silicon carbide non continuous fibers, the present inventors manufactured by using the high pressure casting method samples of various further composite materials. Since no suitable non continuous silicon carbide fibers as such are currently being made by any commercial manufacturer, the present inventors settled upon utilizing as reinforcing material silicon carbide non continuous fiber material which they themselves produced by cutting silicon carbide continuous fibers of type "Nikaron" (this is a trademark) made by Nihon Carbon K.K., which had fiber diameters 10 to 15 microns, to lengths of about 5 mm. Further, in these various composite material samples, there were utilized as matrix metal Al-Cu-Si type aluminum alloys of the forty two previously specified compositions A1 through A42. Then the present inventors conducted evaluations of the bending strength of the various resulting composite material sample pieces.

Figure 4:
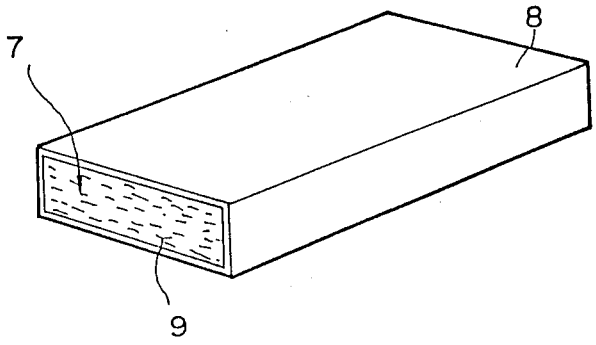
FIG. 4 is a perspective view, similar to FIG. 1 relating to its said certain preferred embodiments, showing a preform made of silicon carbide or silicon nitride non continuous fiber material enclosed in a stainless steel case one end at least of which is open, with said silicon carbide or silicon nitride non continuous fiber being aligned substantially randomly in two dimensions and being stacked in layers in the third dimension perpendicular to said two dimensions, for incorporation into composite materials according to other various preferred embodiments of the present invention.

In detail, first a set of substantially the same aluminum alloys designated as A1 through A42 were produced, having as base material aluminum and having various quantities of silicon and copper mixed therewith, as described before and summarized in the appended Table. And an appropriate number (actually 84) of silicon carbide non continuous fiber material preforms were made by, in each case, subjecting a quantity of the above specified silicon carbide non continuous fiber material to compression forming while using polyvinyl alcohol as a binder. Each of these silicon carbide non continuous fiber material preforms, after thus being compression formed, and while the polyvinyl alcohol binder with which it was impregnated was still wet, as schematically illustrated in perspective view in FIG. 4 wherein an exemplary such preform is designated by the reference numeral 7 and the silicon carbide non continuous fibers therein are generally designated as 9, was inserted into a stainless steel case 8 which was about 38×100×16 mm in dimensions and had at least one of its ends open, with the individual silicon carbide non continuous fibers 9 in said preform 7 being oriented as overlapping in a two dimensionally random manner in the plane parallel to the 38×100 mm plane while being stacked in the direction perpendicular to this plane. After this, each of these stainless steel cases 8 with its preform 7 held inside it was heated in an oven to a temperature of about 600° C. for about one hour, whereby in each case the polyvinyl alcohol binder originally soaked into said preform 7 was substantially completely dried out and removed. And the fiber volume proportion in each of half of this set of said preforms 2, i.e. in 42 of them, was approximately 40%; while the fiber volume proportion in each of the other half of said set of said preforms 2, i.e. in the other 42 of them, was approximately 20%.

Next, each of these silicon carbide non continuous fiber material preforms 2 was subjected to high pressure casting together with an appropriate quantity of one of the aluminum alloys A1 through A42 described above, in substantially the same way as in the case of the first set of preferred embodiments described above, and thereby two sample pieces of composite material which had silicon carbide non continuous fiber material as reinforcing material were formed for each one of the aluminum alloys A1 through A42 as matrix metal, with the volume proportions of silicon carbide non continuous fibers in these two resulting composite material sample pieces being approximately 40% and approximately 20%.

Next, post processing steps were performed on the composite material samples, as described earlier; thus, liquidizing processing and artificial aging processing were performed. Then, from each of the composite material sample pieces manufactured as described above, to which heat treatment had been applied, there was cut a bending strength test piece of the same dimensions as before, with the plane of two dimensional random fiber orientation being parallel to the 50×10 mm faces of each of the test pieces, and for each of these composite material bending strength test pieces a three point bending strength test was carried out, as before.

Figure 5:
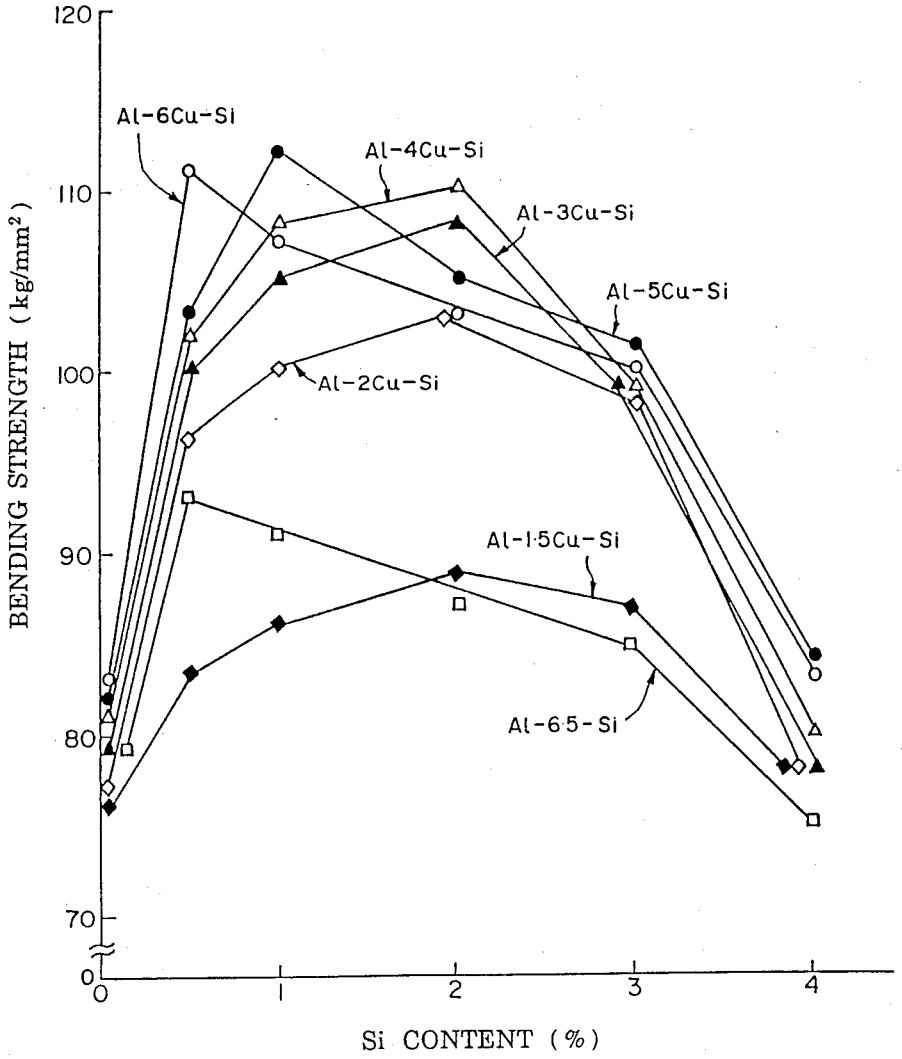
FIG. 5 is a set of graphs, similar to FIG. 3 for the first set of preferred embodiments, in which silicon content in percent is shown along the horizontal axis and bending strength in $kg/mm^2$ is shown along the vertical axis, derived from data relating to bending strength tests for certain ones of the second set of preferred embodiments of the material of the present invention (in which the volume proportion of reinforcing silicon carbide non continuous fibers was approximately 40%), each said graph showing the relation between silicon content and bending strength of certain composite material test pieces for a particular fixed percentage content of copper in the matrix metal of the composite material.
Figure 6:
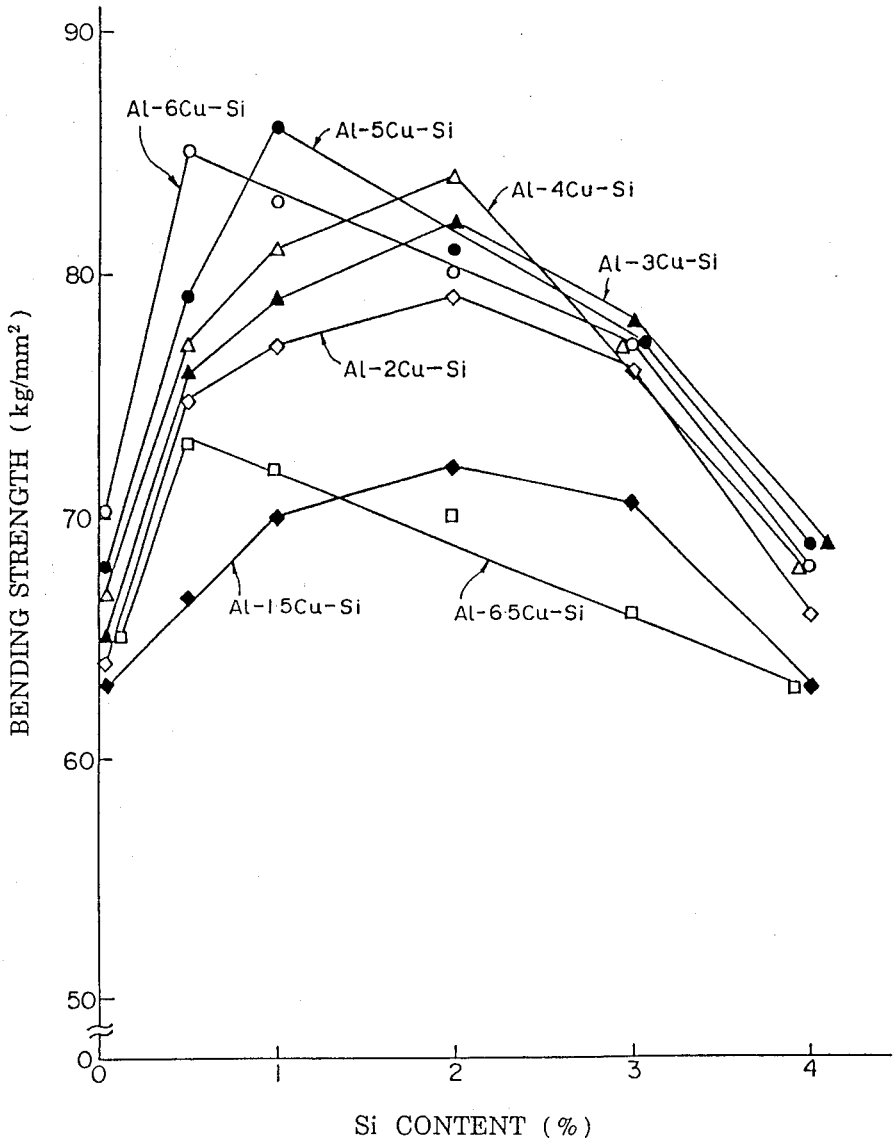
FIG. 6 is a set of graphs, similar to FIG. 3 for the first set of preferred embodiments and FIG. 5 for said certain ones of the second preferred embodiment set, in which silicon content in percent is shown along the horizontal axis and bending strength in kg/mm$^2$ is shown along the vertical axis, derived from data relating to bending strength tests for certain other ones of the second set of preferred embodiments of the material of the present invention (in which the volume proportion of reinforcing silicon carbide non continuous fibers was approximately 20%), each said graph similarly showing the relation between silicon content and bending strength of certain composite material test pieces for a particular fixed percentage content of copper in the matrix metal of the composite material.

The results of these bending strength tests were as shown and summarized in the line graphs of FIGS. 5 and 6; FIG. 5 relates to the 42 of the test samples which had fiber volume proportions of approximately 40%, while on the other hand FIG. 6 relates to the 42 of the test samples which had fiber volume proportions of approximately 20%. Similarly to the previous case of FIG. 3, each of the line graphs of FIGS. 5 and 6 shows the relation between silicon content (in percent) shown along the horizontal axis and the bending strength (in $kg/mm^2$) shown along the vertical axis of certain of the composite material test pieces having as matrix metals aluminum alloys with percentage content of silicon as shown along the horizontal axis and with percentage content of copper fixed along said line graph, and having as reinforcing material the silicon carbide fibers specified above, in the respective fiber volume proportion.

From FIGS. 5 and 6 it will be understood that, both in the case that the volume proportion of the reinforcing silicon carbide fiber material was approximately 40% and in the case that said fiber volume proportion was approximately 20%, substantially irrespective fo the silicon content of the aluminum alloy matrix metal of the bending strength composite material test pieces, when the copper content was either at the low extreme of approximately 1.5% or at the high extreme of approximately 6.5% the bending strength of the composite material had a relatively low value; and, contrariwise, when the copper content was between the more intermediate points of approximately 2% and approximately 6%, except in the extreme cases that the silicon content was approximately 0% or was approximately 4%, the bending strength of the composite material was considerably higher than when the copper content was either at the low extreme of approximately 1.5% or at the high extreme of approximately 6.5%. Accordingly, it will be understood that, again, it is considered to be preferable for the copper content to be between approximately 2% and approximately 6%. Further, it will be seen that, again both in the case that the volume proportion of the reinforcing silicon carbide fiber material was approximately 40% and in the case that said fiber volume proportion was approximately 20%, when the silicon content was between the more intermediate points of approximately 0.5% to approximately 3%, except in the extreme cases that the copper content was approximately 1.5% or was approximately 6.5%, the bending strength of the composite material was significantly greater than when the silicon content was either at the low extreme of approximately 0% or at the high extreme of approximately 4%. And, particularly in the case that the copper content had a relatively low value within the range of approximately 2% to 4%, the bending strength of the composite material attained a substantially maximum value when the silicon content was approximately 2%. On the other hand, in the particular case that the copper content had a relatively high value within the range of approximately 5% to 6%, the bending strength of the composite material attained a substantially maximum value when the silicon content was between approximately 0.5% and approximately 1%. Accordingly, it will be understood that, again, it is considered to be preferable for the silicon content to be between approximately 0.5% and approximately 3%.

It will be further seen that the values in FIGS. 5 and 6 are generally much higher than the typical bending strengths of respectively approximately 63 $kg/mm^2$ and approximately 55 $kg/mm^2$ attained in the conventional art for a composite material using as matrix metal a conventionally so utilized aluminum alloy of JIS standard AC4C and using a similar slicon carbide non continuous type fiber material as reinforcing material in the similar respective fiber volume proportions of 40% and 20%. Further, it will be seen that, for the particular above described types of such composite material having respective volume proportions of approximately 40% and approximately 20% of silicon carbide non continuous fiber material as reinforcing fiber material and using an aluminum alloy as matrix metal with a copper content of from approximately 2% to approximately 6% and with a silicon content of from approximately 0.5% to approximately 3%, the bending strength values are respectively between approximately 1.6 and approximately 1.8 times, and between approximately 1.4 and approximately 1.6 times, the abovementioned typical bending strengths of approximately 63 $kg/mm^2$ and approximately 55 $kg/mm^2$ attained by the above mentioned conventional composite materials.

From the results of these bending strength tests it will be seen that, in order to provide for a good and appropriate bending strength for a composite material having as reinforcing fiber material silicon carbide non continuous fibers in volume proportion of approximately 40% or in volume proportion of approximately 20%, and having as matrix metal an Al-Cu-Si type aluminum alloy, again it is preferable that the copper content of said Al-Cu-Si type aluminum alloy matrix metal should be in the range of from approximately 2% to approximately 6% while the silicon content of said Al-Cu-Si type aluminum alloy matrix metal should be in the range of from approximately 0.5% to approximately 3%.

The Third Set Of Preferred Embodiments

Next, the present inventors manufactured further samples of various composite materials, again utilizing as reinforcing material the same silicon carbide non continuous type fiber material, and utilizing as matrix metal substantially the same 42 types of Al-Cu-Si type aluminum alloys, but this time employing a fiber volume proportion of only approximately 15%. Then the present inventors again conducted evaluations of the bending strength of the various resulting composite material sample pieces.

First, a set of 42 aluminum alloys the same as those utilized in the first and the second set of preferred embodiments were produced in the same manner as before, again having as base material aluminum and having various quantities of silicon and copper mixed therewith. And an appropriate number of silicon carbide non continuous type fiber material preforms were as before made by the method disclosed above with respect to the second set of preferred embodiment, each of said silicon carbide non continuous type fiber material preforms now having a fiber volume proportion of approximately 15%, by contrast to the second set of preferred embodiments described above. These preforms had substantially the same dimensions as the preforms of the first and second sets of preferred embodiments.

Next, substantially as before, each of these silicon carbide non continuous fiber type material preforms was subjected to high pressure casting together with an appropriate quantity of one of the aluminum alloys A1 through A42 described above, utilizing operational parameters substantially as before. The solidified aluminum alloy mass with the preform included therein was then removed from the casting mold, and the peripheral portion of said solidified aluminum alloy mass was machined away, leaving only a sample piece of composite material which had silicon carbide non continuous type fiber material as reiforcing material and the appropriate one of the aluminum alloys A1 through A42 as matrix metal. The volume proportion of silicon carbide fibers in each of the resulting composite material sample pieces was thus now approximately 15%. And post processing steps were performed on the composite material samples, substantially as before. From each of the composite material sample pieces manufactured as described above, to which heat treatment had been applied, there was cut a bending strength test piece of dimensions and parameters substantially as in the case of the second set of preferred embodiments, and for each of these composite material bending strength test pieces a bending strength test was carried out, again substantially as before.

Figure 7:
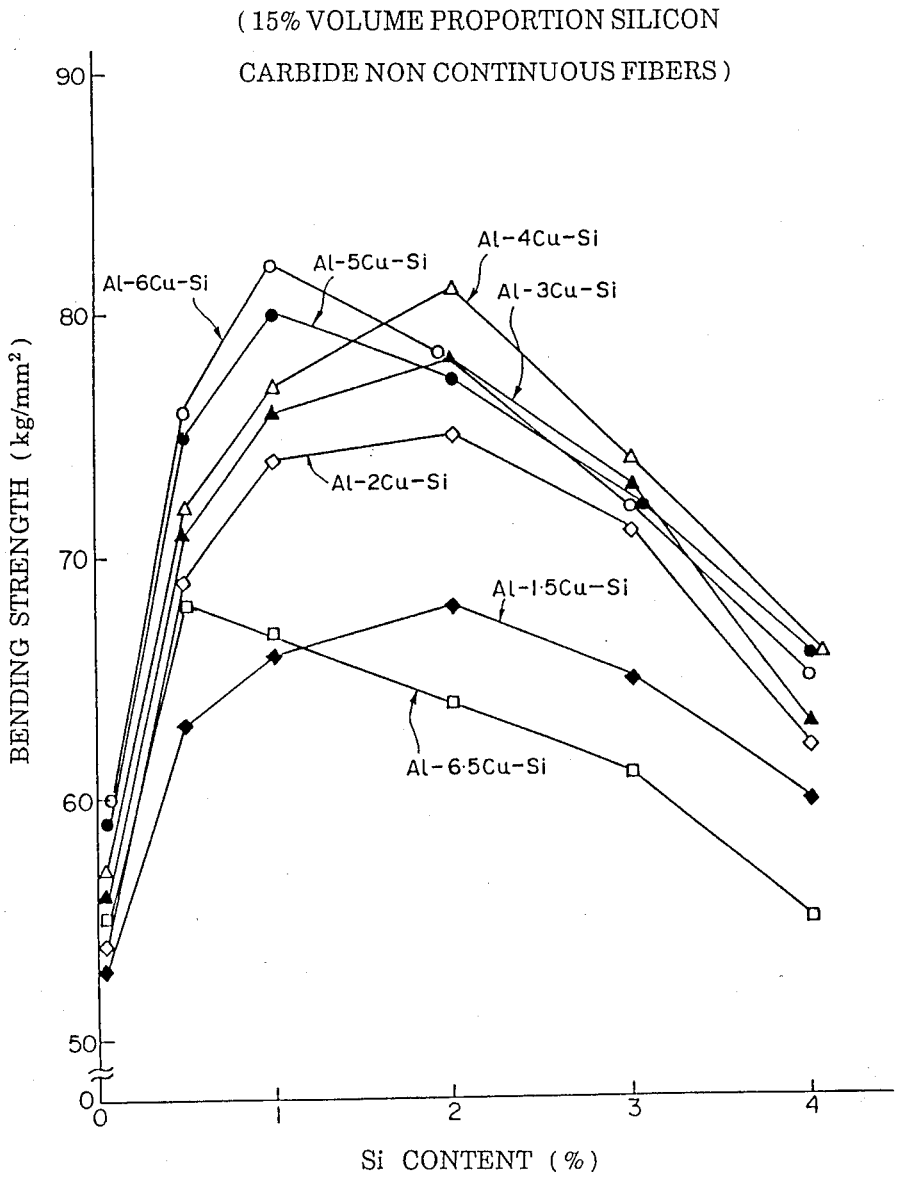
FIG. 7 is a set of graphs, similar to FIG. 3 of the first set of preferred embodiments and FIGS. 5 and 6 for the second set of preferred embodiments, in which again silicon content in percent is shown along the horizontal axis and bending strength in kg/mm$^2$ is shown along the vertical axis, derived from data relating to bending strength tests for the third set of preferred embodiments of the material of the present invention (in which the volume proportion of reinforcing silicon carbide non continuous fibers was now approximately 15%), each said graph similarly showing the relation between silicon content and bending strength of certain composite material test pieces for a particular fixed percentage content of copper in the matrix metal of the composite material.

The results of these bending strength tests were as summarized in the graphs of FIG. 7; thus, FIG. 7 corresponds to FIG. 3 relating to the first set of preferred embodiments and to FIGS. 5 and 6 relating to the second set of preferred embodiments. In the graphs of FIG. 7, there are shown relations between silicon content and the bending strength (in kg/mm$^2$) of certain of the composite material test pieces, for percentage contents of copper fixed along the various lines thereof.

From FIG. 7 it will be again similarly understood that, in this case that the volume proportion of the reinforcing silicon carbide fiber material was approximately 15%, substantially irrespective of the silicon content of the aluminum alloy matrix metal of the bending strength composite material test pieces, when the copper content was either at the low extreme of approximately 1.5% or at the high extreme of approximately 6.5% the bending strength of the composite material had a relatively low value; and, contrariwise, when the copper content was between the more intermediate points of approximately 2% and approximately 6%, except in the extreme cases that the silicon content was approximately 0% or was approximately 4%, the bending strength of the composite material was considerably higher than when the copper content was either at the low extreme of approximately 1.5% or at the high extreme of approximately 6.5%. Accordingly, it will be understood that, again, it is considered to be preferable for the copper content to be between approximately 2% and approximately 6%. Further, it will be seen that, in this case that the volume proportion of the reinforcing silicon carbide non continuous fiber material was approximately 15%, when the silicon content was between the more intermediate points of approximately 0.5% to approximately 3%, except in the extreme cases that the copper content was approximately 1.5% or was approximately 6.5%, the bending strength of the composite material was significantly greater than when the silicon content was either at the low extreme of approximately 0% or at the high extreme of approximately 4%. And, particularly in the case that the copper content had a relatively low value within the range of approximately 2% to 4%, the bending strength of the composite material attained a substantially maximum value when the silicon content was approximately 2%. On the other hand, in the particular case that the copper content had a relatively high value within the range of approximately 5% to 6%, the bending strength of the composite material attained a substantially maximum value when the silicon content was approximately 1%. Accordingly, it will be understood that, again, it is considered to be preferable for the silicon content to be between approximately 0.5% and approximately 3%.

It will be further seen that the values in FIG. 7 are generally much higher than the typical bending strength of approximately 53 kg/mm$^2$ attained in the conventional art for a composite material using as matrix metal a conventionally so utilized aluminum alloy of JIS standard AC4C and using a similar silicon carbide non continuous type fiber material as reinforcing material in the similar fiber volume proportion of approximately 15%. Further, it will be seen that, for the particular above described type of such composite material having volume proportion of approximately 15% of silicon carbide non continuous fiber material as reinforcing fiber material and using an aluminum alloy as matrix metal with a copper content of from approximately 2% to approximately 6% and with a silicon content of from approximately 0.5% to approximately 3%, the bending strength value is between approximately 1.3 and approximately 1.6 times the abovementioned typical bending strength of approximately 53 kg/mm$^2$ attained by the above mentioned conventional composite material.

From the results of these bending strength tests it will be seen that, in order to provide for a good and appropriate bending strength for a composite material having as reinforcing fiber material silicon carbide non continuous fibers in volume proportion of approximately 15% and having as matrix metal an Al-Cu-Si type aluminum alloy, again it is preferable that the copper content of said Al-Cu-Si type aluminum alloy matrix metal should be in the range of from approximately 2% to approximately 6% while the silicon content of said Al-Cu-Si type aluminum alloy matrix metal should be in the range of from approximately 0.5% to approximately 3%.

The Fourth Set of Preferred Embodiments

Next, the present inventors manufactured further samples of various composite materials, this time utilizing as reinforcing material the same silicon carbide whisker type short type fiber material as utilized in the first set of preferred embodiments described above, and utilizing as matrix metal substantially the same 42 types of Al-Cu-Si type aluminum alloys, but this time employing fiber volume proportions of only approximately 10% and 5%. Then the present inventors again conducted evaluations of the bending strength of the various resulting composite material sample pieces.

First, a set of 42 aluminum alloys the same as those utilized in the previously described sets of preferred embodiments were produced in the same manner as before, again having as base material aluminum and having various quantities of silicon and copper mixed therewith. And an appropriate number (actually 84) of silicon carbide whisker type short type fiber material preforms were as before made by the method disclosed above with respect to the first set of preferred embodiments, each of a first set (in number 42) of said silicon carbide whisker type short type fiber material preforms now having a fiber volume proportion of approximately 10%, and each of a second set (also in number 42) of said silicon carbide whisker type short type fiber material preforms now having a fiber volume proportion of approximately 5%, by contrast to the first set of preferred embodiments described above. These preforms had substantially the same dimensions as the preforms of the previously described sets of preferred embodiments.

Next, substantially as before, each of these silicon carbide whisker type short fiber type material preforms was subjected to high pressure casting together with an appropriate quantity of one of the aluminum alloys A1 through A42 described above, utilizing operational parameters substantially as before. The solidified aluminum alloy mass with the preform included therein was then removed from the casting mold, and the peripheral portion of said solidified aluminum alloy mass was machined away, leaving only a sample piece of composite material which had silicon carbide whisker type short type fiber material as reinforcing material and the appropriate one of the aluminum alloys A1 through A42 as matrix metal. The volume proportion of silicon carbide whisker type short fibers in each of the resulting composite material sample pieces was thus now either approximately 10% or approximately 5%. And post processing steps were performed on the composite material samples, substantially as before. From each of the composite material sample pieces manufactured as described above, to which heat treatment had been applied, there was cut a bending strength test piece of dimensions and parameters substantially as in the case of the first set of preferred embodiments, and for each of these composite material bending strength test pieces a bending strength test was carried out, again substantially as before.

Figure 8:
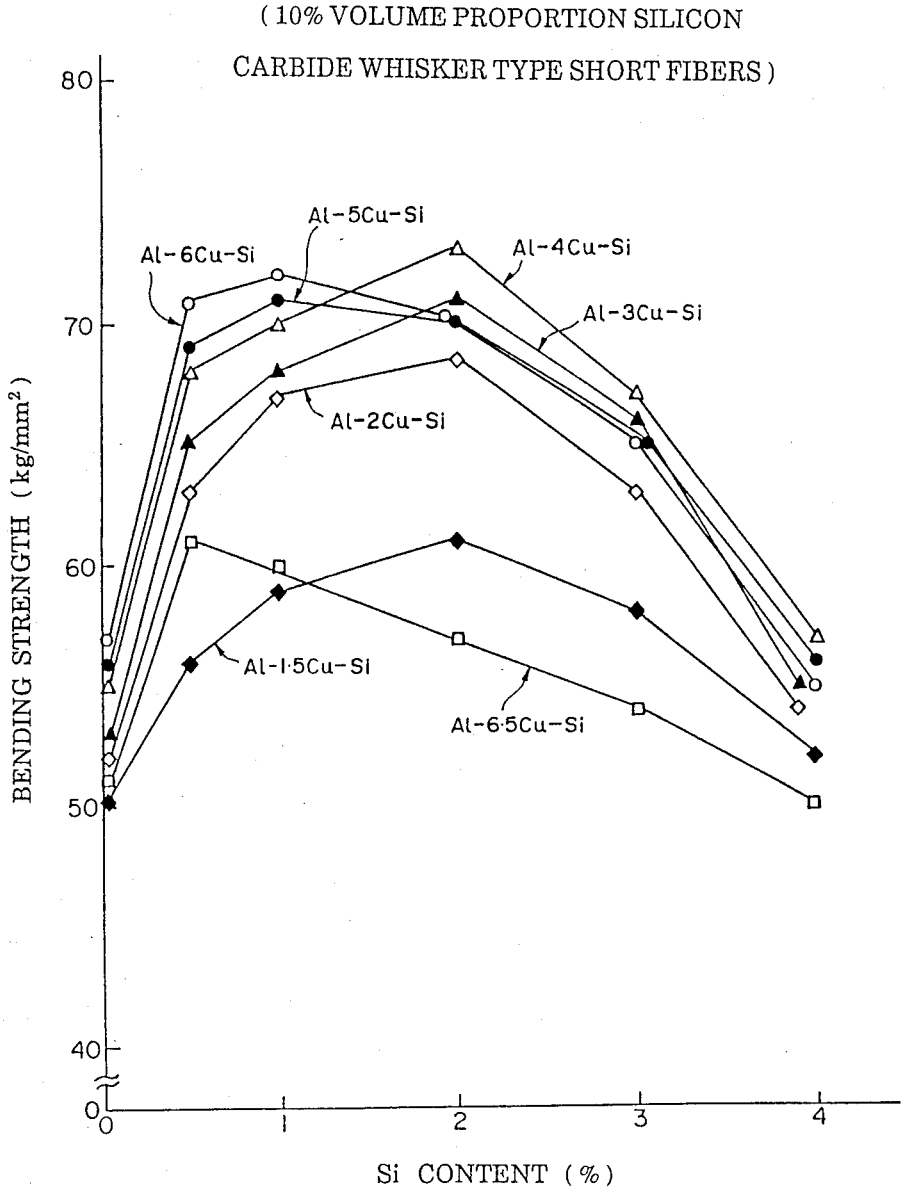
FIG. 8 is a set of graphs, similar to FIG. 3 for the first set of preferred embodiments, FIGS. 5 and 6 for the second set of preferred embodiments, and FIG. 7 for the third set of preferred embodiments, in which again silicon content is percent is shown along the horizontal axis and bending strength in kg/mm$^2$ is shown along the vertical axis, derived from data relating to bending strength tests for certain ones of the fourth set of preferred embodiments of the material of the present invention (in which the volume proportion of reinforcing silicon carbide whisker type short fibers was now approximately 10%), each said graph similarly showing the relation between silicon content and bending strength of certain composite material test pieces for a particular fixed percentage content of copper in the matrix metal of the composite material.
Figure 9:
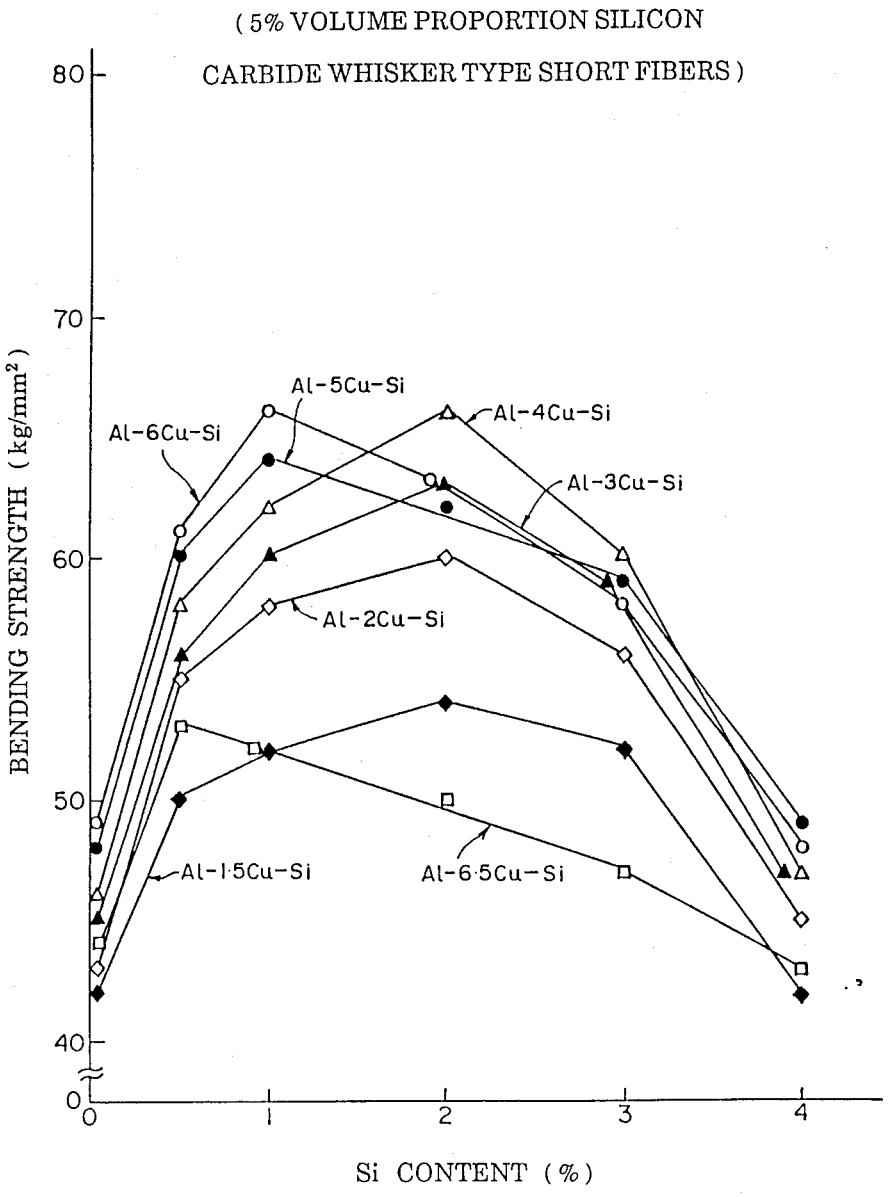
FIG. 9 is a set of graphs, similar to FIG. 3 for the first set of preferred embodiments, FIGS. 5 and 6 for the second set of preferred embodiments, FIG. 7 for the third set of preferred embodiments, and FIG. 8 for said certain ones of the fourth set of preferred embodiments, in which again silicon content in percent is shown along the horizontal axis and bending strength in kg/mm$^2$ is shown along the vertical axis, derived from data relating to bending strength tests for certain other ones of the fourth set of preferred embodiments of the material of the present invention (in which the volume proportion of reinforcing silicon carbide whisker type short fibers was now approximately 50%), each said graph similarly showing the relation between silicon content and bending strength of certain composite material test pieces for a particular fixed percentage content of copper in the matrix metal of the composite material.

The results of these bending strength tests were as summarized in the graphs of FIGS. 8 and 9; thus, FIGS. 8 and 9 correspond to FIG. 3 relating to the first set of preferred embodiments, to FIGS. 5 and 6 relating to the second set of preferred embodiments, and to FIG. 7 relating to the third set of preferred embodiments. In the graphs of FIGS. 8 and 9, again there are shown relations between silicon content and the bending strength (in kg/mm$^2$) of certain of the composite material test pieces, for percentage contents of copper fixed along the various lines thereof.

From FIGS. 8 and 9 it will be again similarly understood that, both in the cases that the volume proportion of the reinforcing silicon carbide whisker type short fiber material was approximately 10% and in the cases that said volume proportion of the reinforcing silicon carbide whisker type short fiber material was approximately 5%, substantially irrespective of the silicon content of the aluminum alloy matrix metal of the bending strength composite material test pieces, when the copper content was either at the low extreme of approximately 1.5% or at the high extreme of approximately 6.5% the bending strength of the composite material had a relatively low value; and, contrariwise, when the copper content was between the more intermediate points of approximately 2% and approximately 6%, except in the extreme cases that the silicon content was approximately 0% or was approximately 4%, the bending strength of the composite material was considerably higher than when the copper content was either at the low extreme of approximately 1.5% or at the high extreme of approximately 6.5%. Accordingly, it will be understood that, again, it is considered to be preferable for the copper content to be between approximately 2% and approximately 6%. Further, it will be seen that, in both these cases that the volume proportion of the reinforcing silicon carbide whisker type short fiber material was approximately 10% and was approximately 5%, when the silicon content was between the more intermediate points of approximately 0.5% to approximately 3%, except in the extreme cases that the copper content was approximately 1.5% or was approximately 6.5%, the bending strength of the composite material was significantly greater than when the silicon content was either at the low extreme of approximately 0% or at the high extreme of approximately 4%. And, particularly in the cases that the copper content had a relatively low value within the range of approximately 2% to approximately 4%, the bending strength of the composite material attained a substantially maximum value when the silicon content was approximately 2%. On the other hand, in the particular cases that the copper content had a relatively high value within the range of approximately 5% to approximately 6%, the bending strength of the composite material attained a substantially maximum value when the silicon content was approximately 1%. Accordingly, it will be understood that, again, it is considered to be preferable for the silicon content to be between approximately 0.5% and approximately 3%.

It will be further seen that, except in the extreme cases that the silicon content was approximately 0% or was approximately 4%, the values in FIGS. 8 and 9 are generally much higher than the typical bending strengths of respectively approximately 50 kg/mm$^2$ and approximately b 46 kg/mm$^2$ attained in the conventional art for composite materials using as matrix metal a conventionally so utilized aluminum alloy of JIS standard AC4C and using a similar silicon carbide whisker type short type fiber material as reinforcing material in the similar fiber volume proportions of respectively approximately 10% and approximately 5%. Further, it will be seen that, for the particular above described types of such composite material having respective fiber volume proportions of approximately 10% and approximately 5% of silicon carbide whisker type short fiber material as reinforcing fiber material and using an aluminum alloy as matrix metal with a copper content of from approximately 2% to approximately 6% and with a silicon content of from approximately 0.5% to approximately 3%, the bending strength values are respectively between approximately 1.3 and approximately 1.5 times, and between approximately 1.2 and approximately 1.4 times, the abovementioned typical bending strengths of respectively approximately 50 kg/mm$^2$ and approximately 46 kg/mm$^2$ attained by the above mentioned conventional composite materials.

From the results of these bending strength tests it will be seen that, in order to provide for a good and appropriate bending strength for a composite material having as reinforcing fiber material silicon carbide whisker type short fibers in volume proportions of approximately 10% or alternatively approximately 5% and having as matrix metal an Al-Cu-Si type aluminum alloy, again it is preferable that the copper content of said Al-Cu-Si type aluminum alloy matrix metal should be in the range of from approximately 2% to approximately 6% while the silicon content of said Al-Cu-Si type aluminum alloy matrix metal should be in the range of from approximately 0.5% to approximately 3%.

Comments on the First Through the Fourth Sets of Preferred Embodiments

From the first through the fourth sets of preferred embodiments disclosed above, it will be understood that, in order to provide for a good and appropriate bending strength for a composite material having as reinforcing fiber material silicon carbide short fibers and having as matrix metal an Al-Cu-Si type aluminum alloy, irrespective of the particular volume proportions of the short fibers and irrespective of whether said short fibers are whisker type short fibers or are non continuous type fibers, it is preferable that the copper content of said Al-Cu-Si type aluminum alloy matrix metal should be in the range of from approximately 2% to approximately 6% while the silicon content of said Al-Cu-Si type aluminum alloy matrix metal should be in the range of from approximately 0.5% to approximately 3%.

The Fifth Set of Preferred Embodiments

For the fifth set of preferred embodiments of the present invention, a different type of reinforcing fiber was chosen. The present inventors manufactured by using the high pressure casting method samples of various composite materials, utilizing as reinforcing material silicon nitride whisker material made by Tateho Kagaku K.K., which was a material with average fiber diameter 1 micron and average fiber length 100 microns, and utilizing as matrix metal Al-Cu-Si type aluminum alloys of various compositions. Then the present inventors conducted evaluations of the bending strength of the various resulting composite material sample pieces.

In detail, first, a set of aluminum alloys the same as those designated as A1through A42 for the first four sets of preferred embodiments were produced in the same manner as before, and an appropriate number (in fact, 126) of silicon nitride whisker material preforms were then made by applying compression forming to masses of the above described silicon nitride short fiber material, without using any binder, in the same way as in the first set of preferred embodiments described above. Each of the resulting silicon nitride whisker material preforms had dimensions and three dimensional substantially random fiber orientation characteristics substantially as in the first set of preferred embodiments, and: one third of them (i.e. 42) had a volume proportion of the silicon nitride short fibers of approximately 40%; another third of them (i.e. another 42) had a volume proportion of the silicon nitride short fibers of approximately 30%; and the other third of them (i.e. the remaining 42) had a volume proportion of the silicon nitride short fibers of approximately 20%.

Next, substantially as before, each of these silicon nitride whisker material preforms was subjected to high pressure casting together with an appropriate quantitiy of one of the aluminum alloys A1through A42 described above, utilizing operational parameters substantially as in the first set of preferred embodiments. The solidified aluminum alloy mass with the preform included therein was then removed from the casting mold, and the peripheral portion of said solidified aluminum alloy mass was machined away, leaving, in each case, only a sample piece of composite material which had silicon nitride fiber whisker material as reinforcing material and the appropriate one of the aluminum alloys A1 through A42 as matrix metal. The volume proportion of silicon nitride fibers in a third of the resulting composite material sample pieces was thus now approximately 40%, while in another third of said resulting composite material sample pieces the volume proportion of silicon nitride fibers was now approximately 30%, and in the remaining third of said resulting composite material sample pieces the volume proportion of silicon nitride fibers was now approximately 20%. And post processing steps of liquidizing processing and artificial aging processing were performed on the composite material samples, substantially as before. From each of the composite material sample pieces manufactured as described above, to which heat treatment had been applied, there was cut a bending strength test piece of dimensions substantially as before. And then, for each these composite material bending strength test pieces, a bending strength test was carried out, again substantially as before and utilizing the same operational parameters.

Figure 10:
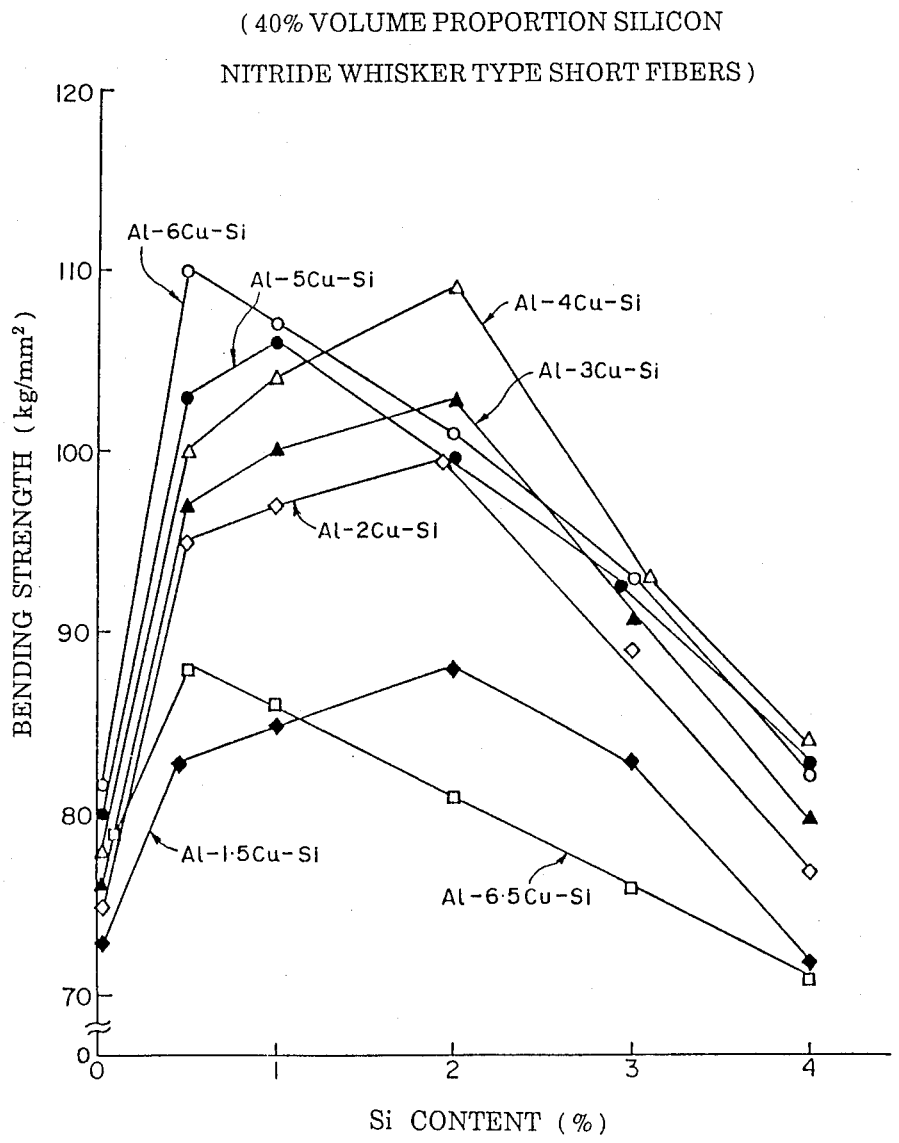
FIG. 10 is a set of graphs, similar to FIG. 3, FIGS. 5 and 6, FIG. 7, and FIGS. 8 and 9 for the first through the fourth sets of preferred embodiments respectively, in which again silicon content in percent is shown along the horizontal axis and bending strength in kg/mm$^2$ is shown along the vertical axis, derived from data relating to bending strength tests for certain ones of the fifth set of preferred embodiments of the material of the present invention (in which the volume proportion of reinforcing silicon nitride whisker type short fibers was approximately 40%), each said graph similarly showing the relation between silicon content and bending strength of certain composite material test pieces for a particular fixed percentage content of copper in the matrix metal of the composite material.
Figure 11:
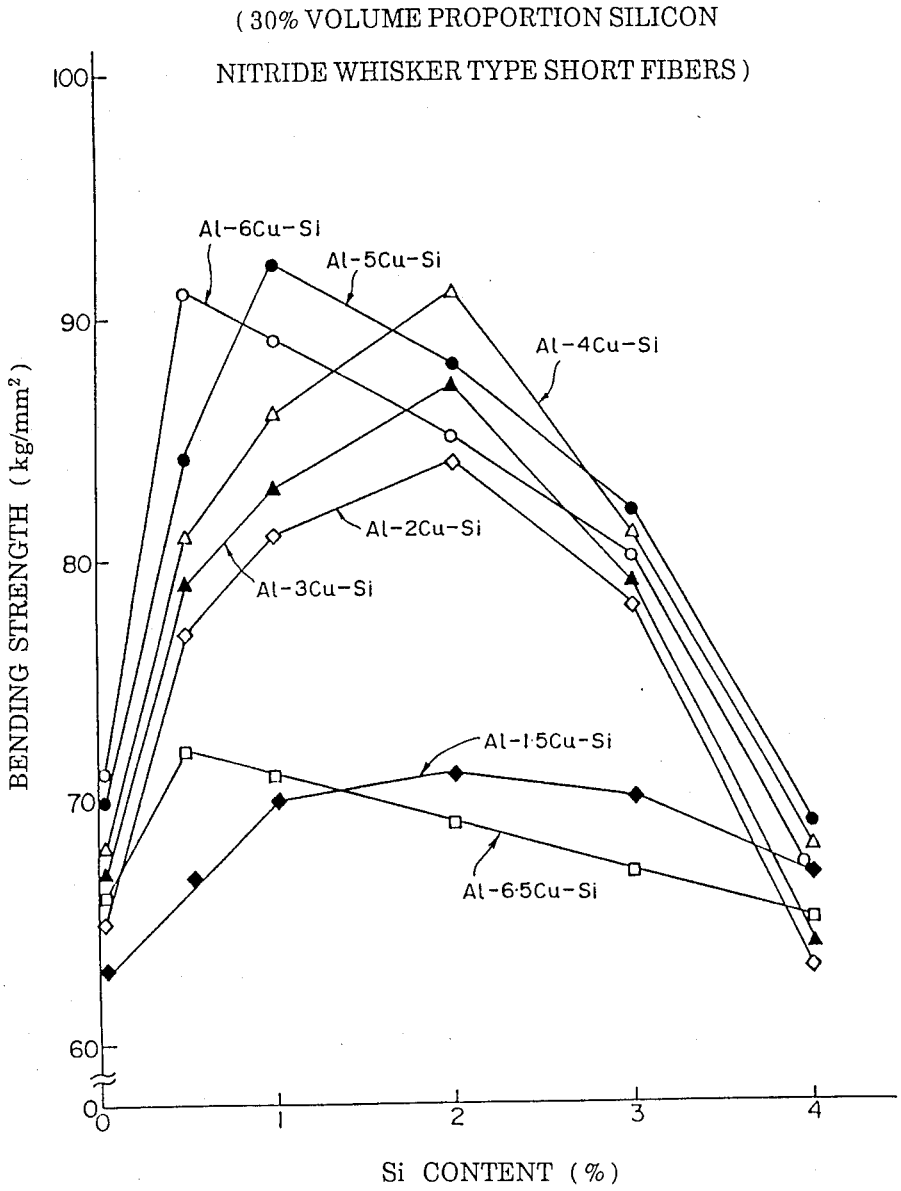
FIG. 11 is a set of graphs, similar to FIG. 3, FIGS. 5 and 6, FIG. 7, and FIGS. 8 and 9 for the first through the fourth set of preferred embodiments respectively, and FIG. 10 for said certain ones of the fifth set of preferred embodiments, in which again silicon content in percent is shown along the horizontal axis and bending strength in kg/mm$^2$ is shown along the vertical axis, derived from data relating to bending strength tests for certain other ones of the fifth set of preferred embodiments of the material of the present invention (in which the volume proportion of reinforcing silicon nitride whisker type short fibers was now approximately 30%), each said graph similarly showing the relation between silicon content and bending strength of certain composite material test pieces for a particular fixed percentage content of copper in the matrix metal of the composite material.
Figure 12:
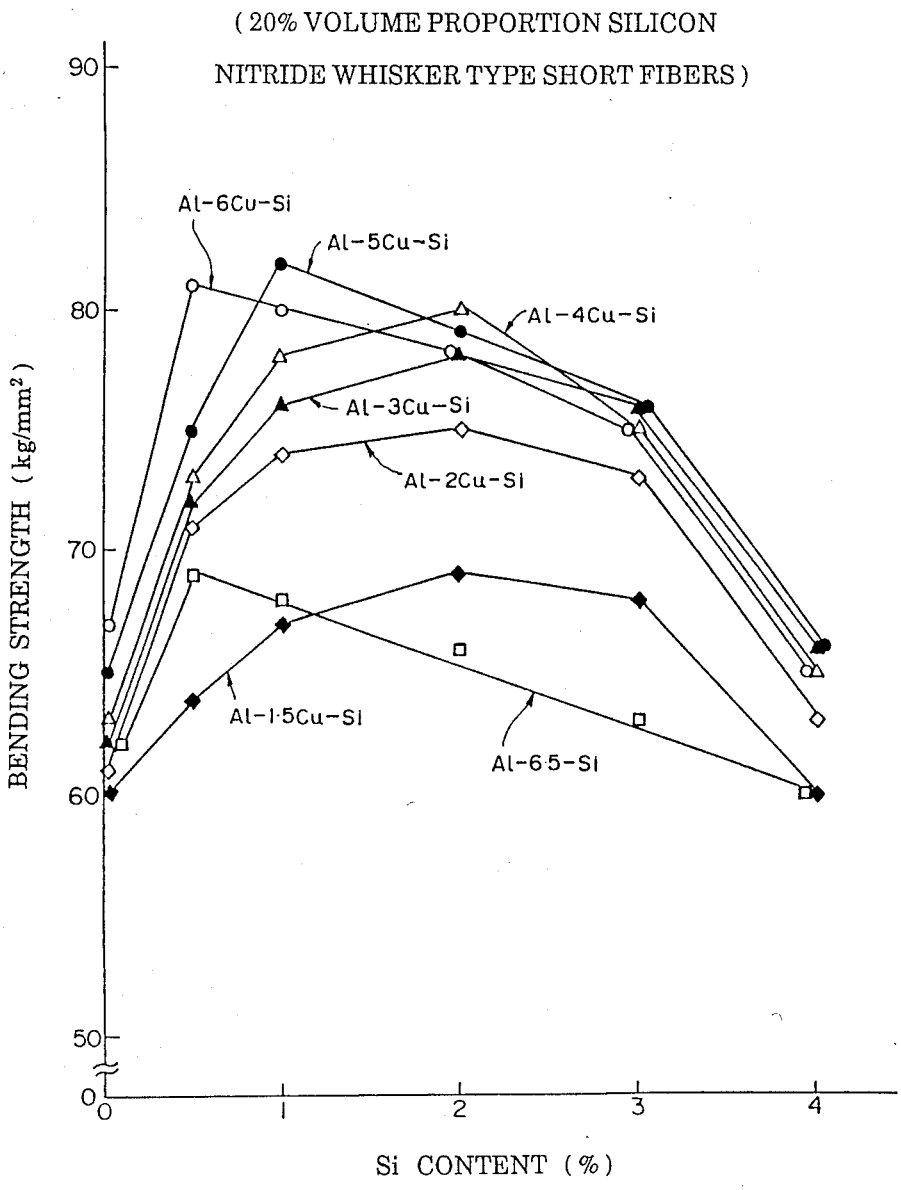
FIG. 12 is a set of graphs, similar to FIG. 3, FIGS. 5 and 6, FIG. 7, and FIGS. 8 and 9 for the first through the fourth sets of preferred embodiments respectively, and FIGS. 10 and 11 for said certain ones and said certain other ones respectively of the fifth set of preferred embodiments, in which again silicon content in percent is shown along the horizontal axis and bending strength in kg/mm$^2$ is shown along the vertical axis, derived from data relating to bending strength tests for certain further other ones of the fifth set of preferred embodiments of the material of the present invention (in which the volume proportion of reinforcing silicon nitride whisker type short fibers was now approximately 20%), each said graph similarly showing the relation between silicon content and bending strength of certain composite material test pieces for a particular fixed percentage content of copper in the matrix metal of the composite material.

The results of these bending strength tests and these shock resistance tests were as summarized in the graphs of FIGS. 10 through 12 for the cases of 40% silicon nitride fiber volume proportion, 30% silicon nitride fiber volume proportion and 20% silicon nitride fiber volume proportion, respectively. Thus, FIGS. 10 through 12 for this fifth set of preferred embodiments of the present invention correspond to FIG. 3, FIGS. 5 and 6, FIG. 7, and FIGS. 8 and 9, respectively relating to the first, the second, the third, and the fourth sets of preferred embodiments described above. In the graphs of FIGS. 10 through 12, again there are shown relations between silicon content and the bending strength (in $kg/mm^2$) of certain of the composite material test pieces, for percentage contents of copper fixed along the various lines thereof.

From FIGS. 10 through 12 it will be again similarly understood that, in all three of these cases in which the volume proportion of the reinforcing silicon nitride whisker type short fiber material was approximately 40%, was approximately 30%, and was approximately 20%, again, substantially irrespective of the silicon content of the aluminum alloy matrix metal of the bending strength composite material test pieces, when the copper content was either at the low extreme of approximately 1.5% or at the high extreme of approximately 6.5% the bending strength of the composite material had a relatively low value; and, contrariwise, when the copper content was between the more intermediate points of approximately 2% and approximately 6%, except in the extreme cases that the silicon content was approximately 0% or was approximately 4%, the bending strength of the composite material was considerably higher than when the copper content was either at the low extreme of approximately 1.5% or at the high extreme of approximately 6.5%. Accordingly, it will, again, be understood that it is considered to be preferable for the copper content to be between approximately 2% and approximately 6%. Further, it will be seen that, in all three of these cases that the volume proportion of the reinforcing silicon nitride whisker type short fiber material was approximately 40%, was approximately 30%, and was approximately 20%, when the silicon content was between the more intermediate points of approximately 0.5% to approximately 3%, except in the extreme cases that the copper content was approximately 1.5% or was approximately 6.5%, the bending strength of the composite material was significantly greater than when the silicon content was either at the low extreme of approximately 0% or at the high extreme of approximately 4%. And, particularly in the cases that the copper content had a relatively low value within the range of approximately 2% to approximately 4%, the bending strength of the composite material attained a substantially maximum value when the silicon content was approximately 2%. On the other hand, in the particular cases that the copper content had a relatively high value within the range of approximately 5% to approximately 6%, the bending strength of the composite material attained a substantially maximum value when the silicon content was from approximately 0.5% to approximately 1%. Accordingly, it will be understood that, again, it is considered to be preferable for the silicon content to be between approximately 0.5% and approximately 3%.

It will be further seen that the values in FIGS. 10 through 12 are generally much higher than the typical bending strengths of respectively approximately 60 kg/mm$^2$, approximately 57 kg/mm$^2$, and approximately 53 kg/mm$^2$ attained in the conventional art for composite materials using as matrix metal a conventionally so utilized aluminum alloy of JIS standard AC4C and using a similar silicon nitride whisker type short type fiber material as reinforcing material in the similar fiber volume proportions of respectively approximately 40%, approximately 30%, and approximately 20%. Further, it will be seen that, for the particular above described types of such composite material having respective fiber volume proportions of approximately 40%, approximately 30%, and approximately 20% of silicon nitride whisker type short fiber material as reinforcing fiber material and using an aluminum alloy as matrix metal with a copper content of from approximately 2% to approximately 6% and with a silicon content of from approximately 0.5% to approximately 3%, the bending strength values are respectively between approximately 1.5 and approximately 1.8 times, between approximately 1.4 and approximately 1.6 times, and between approximately 1.3 and approximately 1.6 times, the abovementioned typical bending strengths of respectively approximately 50 kg/mm$^2$ and approximately 46 kg/mm$^2$ attained by the above mentioned conventional composite materials.

From the results of these bending strength tests it will be seen that, in order to provide for a good and appropriate bending strength for a composite material having as reinforcing fiber material silicon nitride whisker type short fibers in volume proportions of approximately 40% or alternatively approximately 30% or yet alternatively approximately 20% and having as matrix metal an Al-Cu-Si type aluminum alloy, again it is preferable that the copper content of said Al-Cu-Si type aluminum alloy matrix metal should be in the range of from approximately 2% to approximately 6% while the silicon content of said Al-Cu-Si type aluminum alloy matrix metal should be in the range of from approximately 0.5% to approximately 3%.

The Sixth Set of Preferred Embodiments

Next, the present inventors manufactured further samples of various composite materials, this time utilizing as reinforcing material the same silicon nitride whisker type short type fiber material as utilized in the fifth set of preferred embodiments described above, and utilizing as matrix metal substantially the same 42 types of Al-Cu-Si type aluminum alloys, but this time employing silicon nitride fiber volume proportions of only approximately 10% and 5%. Then the present inventors again conducted evaluations of the bending strength of the various resulting composite material sample pieces.

First, a set of 42 aluminum alloys the same as those utilized in the previously described sets of preferred embodiments were produced in the same manner as before, again having as base material aluminum and having various quantities of silicon and copper mixed therewith. And an appropriate number (actually 84) of silicon nitride whisker type short type fiber material preforms were as before made by the method disclosed above with respect to the first set of preferred embodiments, each of a first set (in number 42) of said silicon nitride whisker type short type fiber material preforms now having a fiber volume proportion of approximately 10%, and each of a second set (also in number 42) of said silicon nitride whisker type short type fiber material preforms now having a fiber volume proportion of approximately 5%. These preforms again had substantially the same dimensions as the preforms of the previously described sets of preferred embodiments.

Next, substantially as before, each of these silicon nitride whisker type short fiber type material preforms was subjected to high pressure casting together with an appropriate quantity of one of the aluminum alloys A1 through A42 described above, utilizing operational parameters substantially as before. The solidified aluminum alloy mass with the preform included therein was then removed from the casting mold, and the peripheral portion of said solidified aluminum alloy mass was machined away, leaving only a sample piece of composite material which had silicon nitride whisker type short type fiber material as reinforcing material and the appropriate one of the aluminum alloys A1 through A42 as matrix metal. The volume proportion of silicon nitride whisker type short fibers in each of the resulting composite material sample pieces was thus now either approximately 10% or approximately 5%. And post processing steps were performed on the composite material samples, substantially as before. From each of the composite material sample pieces manufactured as described above, to which heat treatment had been applied, there was cut a bending strength test piece of dimensions and parameters substantially as in the case of the first set of preferred embodiments, and for each of these composite material bending strength test pieces a bending strength test was carried out, again substantially as before.

Figure 13:
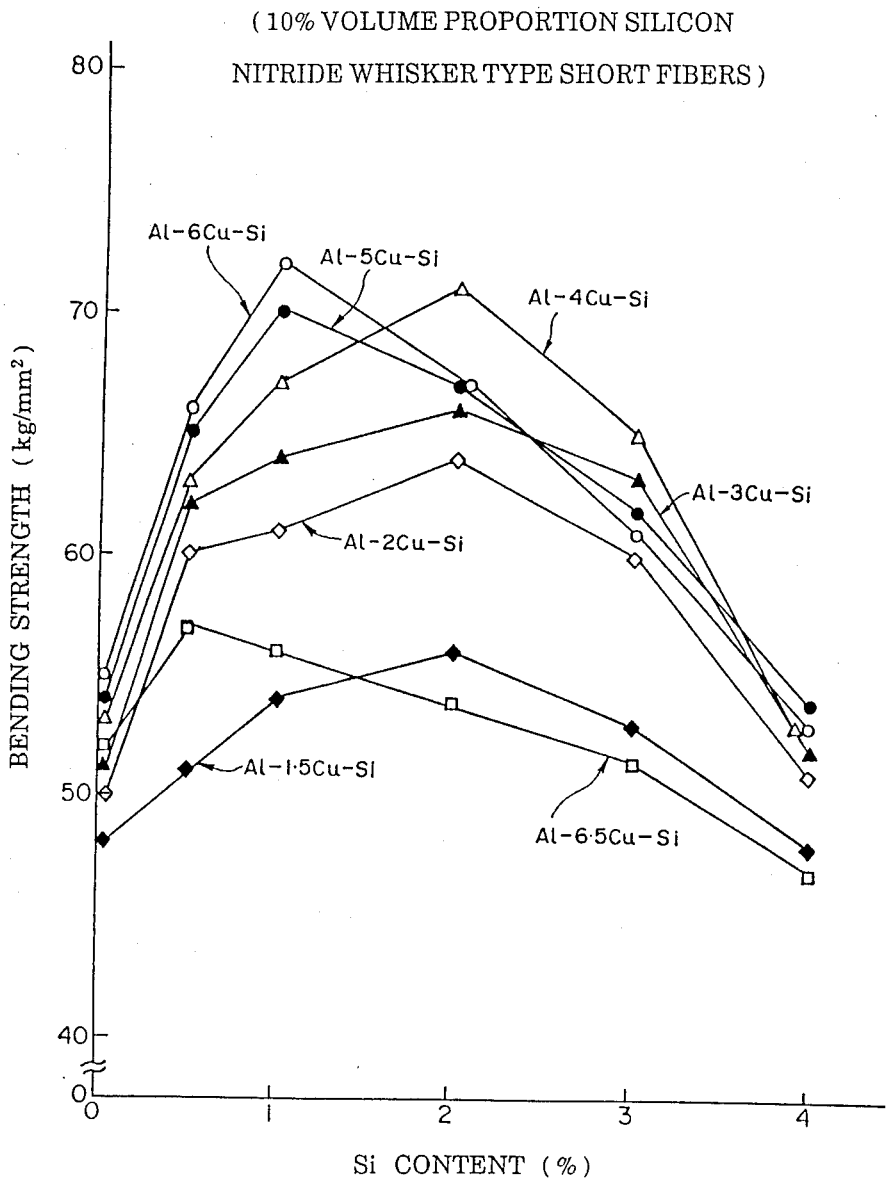
FIG. 13 is a set of graphs, similar to FIG. 3, FIGS. 5 and 6, FIG. 7, FIGS. 8 and 9 and FIGS. 10 through 12 for the first through the fifth sets of preferred embodiments respectively, in which again silicon content in percent is shown along the horizontal axis and bending strength in kg/mm$^2$ is shown along the vertical axis, derived from data relating to bending strength tests for certain ones of the sixth set of preferred embodiments of the material of the present invention (in which the volume proportion of reinforcing silicon nitride whisker type short fibers was now approximately 10%), each said graph similarly showing the relation between silicon content and bending strength of certain composite material test pieces for a particular fixed percentage content of copper in the matrix metal of the composite material.
Figure 14:
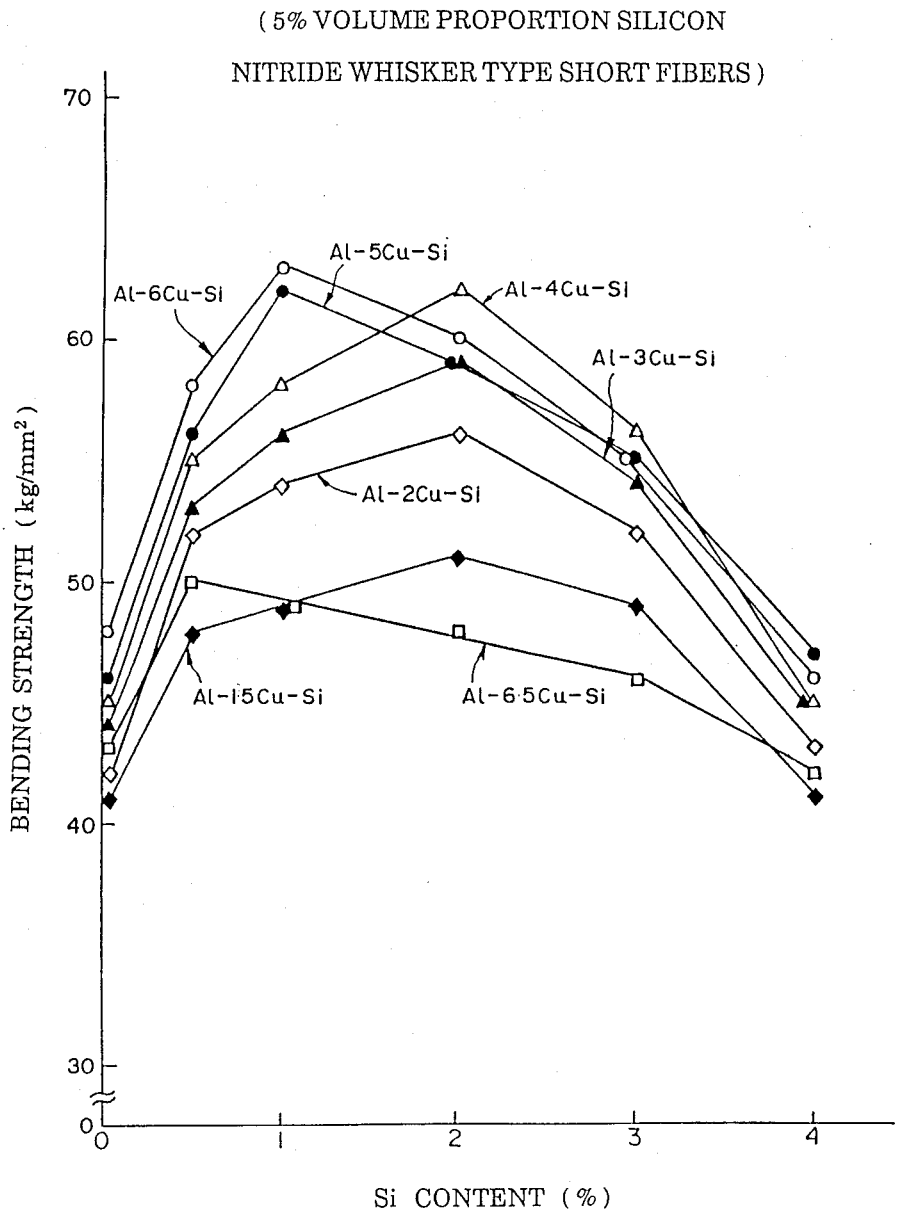
FIG. 14 is a set of graphs, similar to FIG. 3, FIGS. 5 and 6, FIG. 7, FIGS. 8 and 9 and FIGS. 10 through 12 for the first through the fifth sets of preferred embodiments respectively, and to FIG. 13 for said certain ones of the sixth set of preferred embodiments, in which again silicon content in percent is shown along the horizontal axis and bending strength in kg/mm$^2$ is shown along the vertical axis, derived from data relating to bending strength tests for certain other ones of the sixth set of preferred embodiments of the material of the present invention (in which the volume proportion of reinforcing silicon nitride whisker type short fibers was now approximately 5%), each said graph similarly showing the relation between silicon content and bending strength of certain composite material test pieces for a particular fixed percentage content of copper in the matrix metal of the composite material.

The results of these bending strength tests were as summarized in the graphs of FIGS. 13 and 14; thus, FIGS. 13 and 14 correspond to FIG. 3, FIGS. 5 and 6, FIG. 7, FIGS. 8 and 9, and FIGS. 10 through 12 respectively relating to the first, the second, the third, the fourth, and the fifth sets of preferred embodiments described above. In the graphs of FIGS. 13 and 14, again there are shown relations between silicon content and the bending strength (in kg/mm$^2$) of certain of the composite material test pieces, for percentage contents of copper fixed along the various lines thereof.

From FIGS. 13 and 14 it will be again similarly understood that, both in the cases that the volume proportion of the reinforcing silicon nitride whisker type short fiber material was approximately 10% and in the cases that said volume proportion of the reinforcing silicon nitride whisker type short fiber material was approximately 5%, substantially irrespective of the silicon content of the aluminum alloy matrix metal of the bending strength composite material test pieces, when the copper content was either at the low extreme of approximately 1.5% or at the high extreme of approximately 6.5% the bending strength of the composite material had a relatively low value; and, contrariwise, when the copper content was between the more intermediate points of approximately 2% and approximately 6%, except in the extreme cases that the silicon content was approximately 0% or was approximately 4%, the bending strength of the composite material was considerably higher than when the copper content was either at the low extreme of approximately 1.5% or at the high extreme of approximately 6.5%. Accordingly, it will be understood that, again, it is considered to be preferable for the copper content to be between approximately 2% and approximately 6%. Further, it will be seen that, in both these cases that the volume proportion of the reinforcing silicon nitride whisker type short fiber material was approximately 10% and was approximately 5%, when the silicon content was between the more intermediate points of approximately 0.5% to approximately 3%, except in the extreme cases that the copper content was approximately 1.5% or was approximately 6.5%, the bending strength of the composite material was significantly greater than when the silicon content was either at the low extreme of approximately 0% or at the high extreme of approximately 4%. And, particularly in the cases that the copper content had a relatively low value within the range of approximately 2% to approximately 4%, the bending strength of the composite material attained a substantially maximum value when the silicon content was approximately 2%. On the other hand, in the particular cases that the copper content had a relatively high value within the range of approximately 5% to approximately 6%, the bending strength of the composite material attained a substantially maximum value when the silicon content was approximately 1%. Accordingly, it will be understood that, again, it is considered to be preferable for the silicon content to be between approximately 0.5% and approximately 3%.

It will be further seen that, except in the extreme cases that the silicon content was approximately 0% or was approximately 4%, the values in FIGS. 13 and 14 are generally much higher than the typical bending strengths of respectively approximately 47 kg/mm$^2$ and approximately 44 kg/mm$^2$ attained in the conventional art for composite materials using as matrix metal a conventionally so utilized aluminum alloy of JIS standard AC4C and using a similar silicon nitride whisker type short type fiber material as reinforcing material in the similar fiber volume proportions of respectively approximately 10% and approximately 5%. Further, it will be seen that, for the particular above described types of such composite material having respective fiber volume proportions of approximately 10% and approximately 5% of silicon nitride whisker type short fiber material as reinforcing fiber material and using an aluminum alloy as matrix metal with a copper content of from approximately 2% to approximately 6% and with a silicon content of from approximately 0.5% to approximately 3%, the bending strength values are respectively between approximately 1.3 and approximately 1.5 times, and between approximately 1.2 and approximately 1.4 times, the abovementioned typical bending strengths of respectively approximately 47 kg/mm$^2$ and approximately 44 kg/mm$^2$ attained by the above mentioned conventional composite materials.

From the results of these bending strength tests it will be seen that, in order to provide for a good and appropriate bending strength for a composite material having as reinforcing fiber material silicon nitride whisker type short fibers in volume proportions of approximately 10% or alternatively approximately 5% and having as matrix metal as Al-Cu-Si type aluminum alloy, again it is preferable that the copper content of said Al-Cu-Si type aluminum alloy matrix metal should be in the range of from approximately 2% to approximately 6% while the silicon content of said Al-Cu-Si type aluminum alloy matrix metal should be in the range of from approximately 0.5% to approximately 3%.

Comments On The Fifth And The Sixth Sets Of Preferred Embodiments

From the fifth and the sixth sets of preferred embodiments disclosed above, it will be understood that, in order to provide for a good and appropriate bending strength for a composite material having as reinforcing fiber material silicon nitride short fibers and having as matrix metal and Al-Cu-Si type aluminum alloy, irrespective of the volume proportion of said short fibers, it is preferable that the copper content of said Al-Cu-Si type aluminum alloy matrix metal should be in the range of from approximately 2% to approximately 6% while the silicon content of said Al-Cu-Si type aluminum alloy matrix metal should be in the range of from approximately 0.5% to approximately 3%.

The Seventh Set Of Preferred Embodiments

Next, the present inventors manufactured further samples of various composite materials, this time utilizing as reinforcing material a mixture of silicon carbide and silicon nitride whisker type short type fiber materials, and utilizing as matrix metal substantially the same 42 types of Al-Cu-Si type aluminum alloys, and employing volume proportions of the mixed silicon carbide and silicon nitride fiber of approximately 20% and 30%. Then the present inventors again conducted evaluations of the bending strength of the various resulting composite material sample pieces.

First, a set of 42 aluminum alloys the same as those utilized in the previously described sets of preferred embodiments were produced in the same manner as before, again having as base material aluminum and having various quantities of silicon and copper mixed therewith. And an appropriate number (actually 84) of mixed silicon carbide and silicon nitride whisker type short type fiber material preforms were made by mixing together a quantity of the silicon carbide whisker type short fiber material disclosed above with respect to the first set of preferred embodiments and a quantity of the silicon nitride whisker type short fiber material disclosed above with respect to the fifth set of preferred embodiments. Each of a first set (in number 42) of said mixed silicon carbide and silicon nitride whisker type short type fiber material preforms was composed of substantially equal weight proportions of said silicon carbide and silicon nitride whisker type short type fibers and having a total fiber volume proportion of approximately 20% (so that said silicon carbide whisker type short type fibers had a volume proportion of approximately 10% and also said silicon nitride whisker type short type fibers had a volume proportion of approximately 10%). And each of a second set (also in number 42) of said mixed silicon carbide and silicon nitride whisker type short type fiber material preforms was composed of mutual weight proportions of said silicon carbide and silicon nitride whisker type short type fibers of about three to one, and having a total fiber volume proportion of approximately 30% (so that said silicon carbide whisker type short type fibers had a volume proportion of approximately 22.5% and said silicon nitride whisker type short type fibers had a volume proportion of approximately 7.5%). These preforms again had substantially the same dimensions as the preforms of the previously described sets of preferred embodiments; and the fiber directions were substantially randomly oriented in three dimensions within them.

Next, substantially as before, each of these mixed silicon carbide and silicon nitride whisker type short fiber type material preforms was subjected to high pressure casting together with an appropriate quantity of one of the aluminum alloys A1 through A42 described above, utilizing operational parameters substantially as before. The solidified aluminum alloy mass with the preform included therein was then removed from the casting mold, and the peripheral portion of said solidified aluminum alloy mass was machined away, leaving only a sample piece of composite material which had mixed silicon carbide and silicon nitride whisker type short type fiber material as reinforcing material and the appropriate one of the aluminum alloys A1 through A42 as matrix metal. The volume proportion of mixed silicon carbide and silicon nitride whisker type short fibers in each of the resulting composite material sample pieces was thus now either approximately 20% or approximately 30%. And post processing steps were performed on the composite material samples, substantially as before. From each of the composite material sample pieces manufactured as described above, to which heat treatment had been applied, there was cut a bending strength test piece of dimensions and parameters substantially as in the case of the first set of preferred embodiments, and for each of these composite material bending strength test pieces a bending strength test was carried out, again substantially as before.

Figure 15:
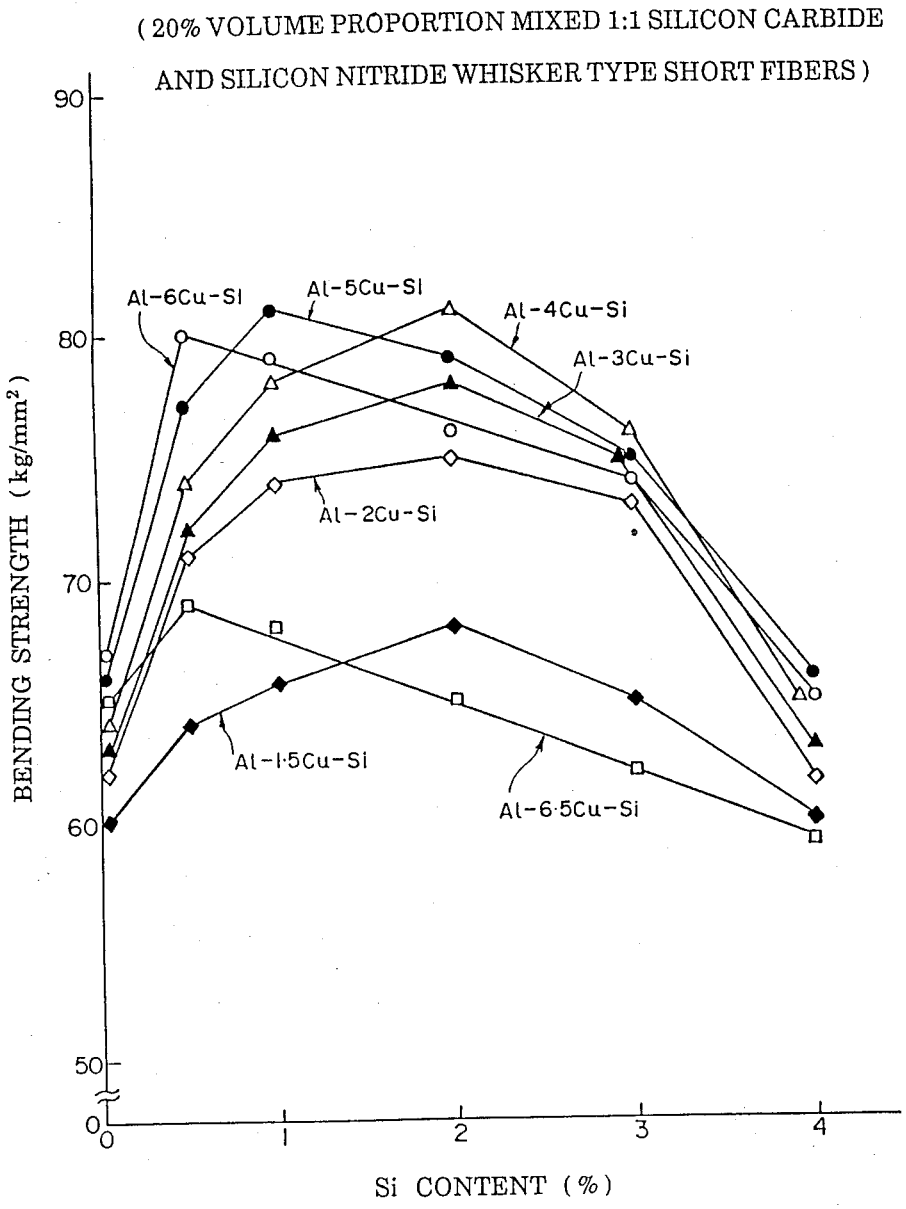
FIG. 15 is a set of graphs, similar to FIG. 3, FIGS. 5 and 6, FIG. 7, FIGS. 8 and 9, FIGS. 10 through 12, and FIGS. 13 and 14 for the first through the sixth sets of preferred embodiments respectively, in which again silicon content in percent is shown along the horizontal axis and bending strength in kg/mm$^2$ is shown along the vertical axis, derived from data relating to bending strength tests for certain ones of the seventh set of preferred embodiments of the material of the present invention (in which the total volume proportion of reinforcing mixed silicon carbide and silicon nitride whisker type short fibers was now approximately 20%, and said silicon carbide and silicon nitride fibers were mixed approximately in an even one to one ratio), each said graph similarly showing the relation between silicon content and bending strength of certain composite material test pieces for a particular fixed percentage content of copper in the matrix metal of the composite material.
Figure 16:
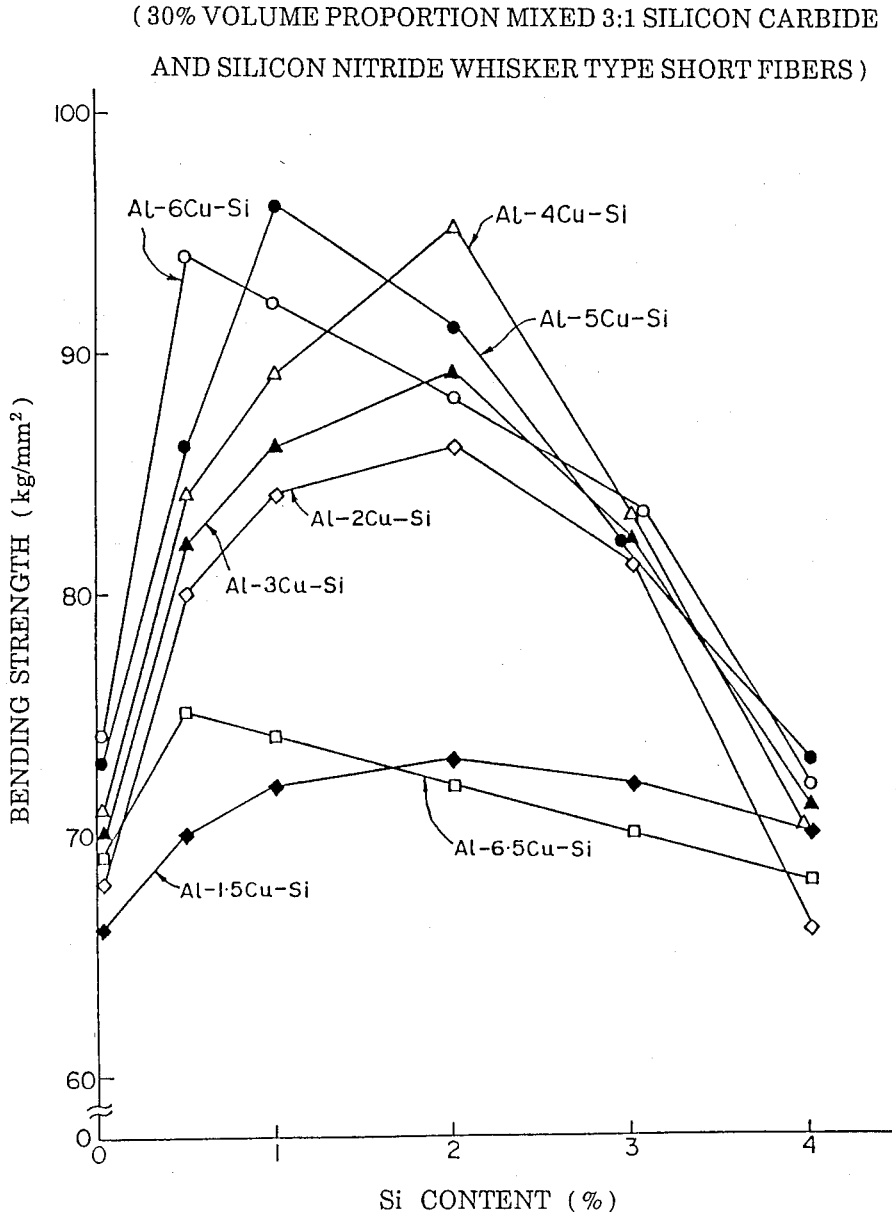
FIG. 16 is a set of graphs, similar to FIG. 3, FIGS. 5 and 6, FIG. 7, FIGS. 8 and 9, FIGS. 10 through 12, and FIGS. 13 and 14 for the first through the sixth sets of preferred embodiments respectively, and to FIG. 15 for certain ones of the seventh set of preferred embodiments, in which again silicon content in percent is shown along the horizontal axis and bending strength in kg/mm$^2$ is shown along the vertical axis, derived from data relating to bending strength tests for certain other ones of the seventh set of preferred embodiments of the material of the present invention (in which the total volume proportion of reinforcing mixed silicon carbide and silicon nitride whisker type short fibers was now approximately 30%, and said silicon carbide and silicon nitride fibers were mixed approximately in a three to one ratio), each said graph similarly showing the relation between silicon content and bending strength of certain composite material test pieces for a particular fixed percentage content of copper in the matrix metal of the composite material.

The results of these bending strength tests were as summarized in the graphs of FIGS. 15 and 16; thus, FIGS. 15 and 16 correspond to FIG. 3, FIGS. 5 and 6, FIG. 7, FIGS. 8 and 9, FIGS. 10 through 12, and FIGS. 13 and 14 respectively relating to the first, the second, the third, the fourth, the fifth, and the sixth sets of preferred embodiments described above. In the graphs of FIGS. 15 and 16, again there are shown relations between silicon content and the bending strength (in kg/mm$^2$) of certain of the composite material test pieces, for percentage contents of copper fixed along the various lines thereof.

From FIGS. 15 and 16 it will be again similarly understood that, both in the cases that the volume proportion of the reinforcing mixed silicon carbide and silicon nitride whisker type short fiber material was approximately 20% and in the cases that said volume proportion of the reinforcing mixed silicon carbide and silicon nitride whisker type short fiber material was approximately 30%, substantially irrespective of the silicon content of the aluminum alloy matrix metal of the bending strength composite material test pieces, when the copper content was either at the low extreme of approximately 1.5% or at the high extreme of approximately 6.5% the bending strength of the composite material had a relatively low value; and, contrariwise, when the copper content was between the more intermediate points of approximately 2% and approximately 6%, except in the extreme cases that the silicon content was approximately 0% or was approximately 4%, the bending strength of the composite material was considerably higher than when the copper content was either at the low extreme of approximately 1.5% or at the high extreme of approximately 6.5%. Accordingly, it will be understood that, again, it is considered to be preferable for the copper content to be between approximately 2% and approximately 6%. Further, it will be seen that, in both these cases that the volume proportion of the reinforcing mixed silicon carbide and silicon nitride whisker type short fiber material was approximately 20% and was approximately 30%, when the silicon content was between the more intermediate points of approximately 0.5% to approximately 3%, except in the extreme cases that the copper content was approximately 1.5% or was approximately 6.5%, the bending strength of the composite material was significantly greater than when the silicon content was either at the low extreme of approximately 0% or at the high extreme of approximately 4%. And, particularly in the cases that the copper content had a relatively low value within the range of approximately 2% to approximately 4%, the bending strength of the composite material attained a substantially maximum value when the silicon ciontent was approximately 2%. On the other hand, in the particular cases that the copper content had a relatively high value within the range of approximately 5% to approximately 6%, the bending strength of the composite material attained a substantially maximum value when the silicon content was in the range from approximately 0.5% to approximately 1%. Accordingly, it will be understood that, again, it is considered to be preferable for the silicon content to be between approximately 0.5% and approximately 3%.

It will be further seen that the values in FIGS. 15 and 16 are generally much higher than the typical bending strengths of respectively approximately 54 kg/mm$^2$ and approximately 59 kg/mm$^2$ attained in the conventional art for composite materials using as matrix metal a conventionally so utilized aluminum alloy of JIS standard AC4C and using a similar mixed silicon carbide and silicon nitride whisker type short type fiber material as reinforcing material in the similar fiber volume proportions of respectively approximately 20% and approximately 30%, with the relative proportions of silicon carbide and silicon nitride whisker type short type fiber material as specified above in each case. Further, it will be seen that, for the particular above described types of such composite material having respective fiber volume proportions of approximately 20% and approximately 30% of mixed silicon carbide and silicon nitride whisker type short fiber material as reinforcing fiber material and using an aluminum alloy as matrix metal with a copper content of from approximately 2% to approximately 6% and with a silicon content of from approximately 0.5% to approximately 3%, the bending strength values are respectively between approximately 1.3 and approximately 1.5 times, and between approximately 1.4 and approximately 1.6 times, the abovementioned typical bending strengths of respectively approximately 54 kg/mm$^2$ and approximately 59 kg/mm$^2$ attained by the above mentioned conventional composite materials.

From the results of these bending strength tests it will be seen that, in order to provide for a good and appropriate bending strength for a composite material having as reinforcing fiber material mixed silicon carbide and silicon nitride whisker type short fibers in volume proportions of approximately 10% and approximately 10% each, or alternatively approximately 22.5% and approximately 7.5% each respectively, and having as matrix metal an Al-Cu-Si type aluminum alloy, again it is preferable that the copper content of said Al-Cu-Si type aluminum alloy matrix metal should be in the range of friom approximately 2% to approximately 6% while the silicon content of said Al-Cu-Si type aluminum alloy matrix metal should be in the range of from approximately 0.5% to approximately 3%.

The Eighth Set Of Preferred Embodiments

Next, the present inventors manufactured further samples of various composite materials, this time again utilizing as reinforcing material a mixture of silicon carbide and silicon nitride whisker type short type fiber materials, and utilizing as matrix metal substantially the same 42 types of Al-Cu-Si type aluminum alloys, and employing volume proportions of the mixed silicon carbide and silicon nitride fiber this time of approximately 10%. Then the present inventors again conducted evaluations of the bending strength of the various resulting composite material sample pieces.

First, a set of 42 aluminum alloys the same as those utilized in the previously described sets of preferred embodiments were produced in the same manner as before, again having as base material aluminum and having various quantities of silicon and copper mixed therewith. And an appropriate number (actually 42) of mixed silicon carbide and silicon nitride whisker type short type fiber material preforms were made by mixing together a quantity of the silicon carbide whisker type short fiber material disclosed above with respect to the first set of preferred embodiments and a quantity of the silicon nitride whisker type short fiber material disclosed above with respect to the fifth set of preferred embodiments, the mutual weight proportions of said silicon carbide and silicon nitride whisker type short type fibers being about one to three, and said preforms having a total fiber volume proportion of approximately 10% (so that said silicon carbide whisker type short type fibers had a volume proportion of approximately 2.5% and said silicon nitride whisker type short type fibers had a volume proportion of approximately 7.5%). These preforms again had substantially the same dimensions as the preforms of the previously described sets of preferred embodiments; and the fiber directions were substantially randomly oriented in three dimensions within them.

Next, substantially as before, each of these mixed silicon carbide and silicon nitride whisker type short fiber type material preforms was subjected to high pressure casting together with an appropriate quantity of one of the aluminum alloys A1 through A42 described above, utilizing operational parameters substantially as before. The solidified aluminum alloy mass with the preform included therein was then removed from the casting mold, and the peripheral portion of said solidified aluminum alloy mass was machined away, leaving only a sample piece of composite material which had mixed silicon carbide and silicon nitride whisker type short type fiber material as reinforcing material and the appropriate one of the aluminum alloys A1 through A42 as matrix metal. The volume proportion of mixed silicon carbide and silicon nitride whisker type short fibers in each of the resulting composite material sample pieces was thus now approximately 10%. And post processing steps were performed on the composite material samples, substantially as before. From each of the composite material sample pieces manufactured as described above, to which heat treatment had been applied, there was cut a bending strength test piece of dimensions and parameters substantially as in the case of the first set of preferred embodiments, and for each of these composite material bending strength test pieces a bending strength test was carried out, again substantially as before.

Figure 17:
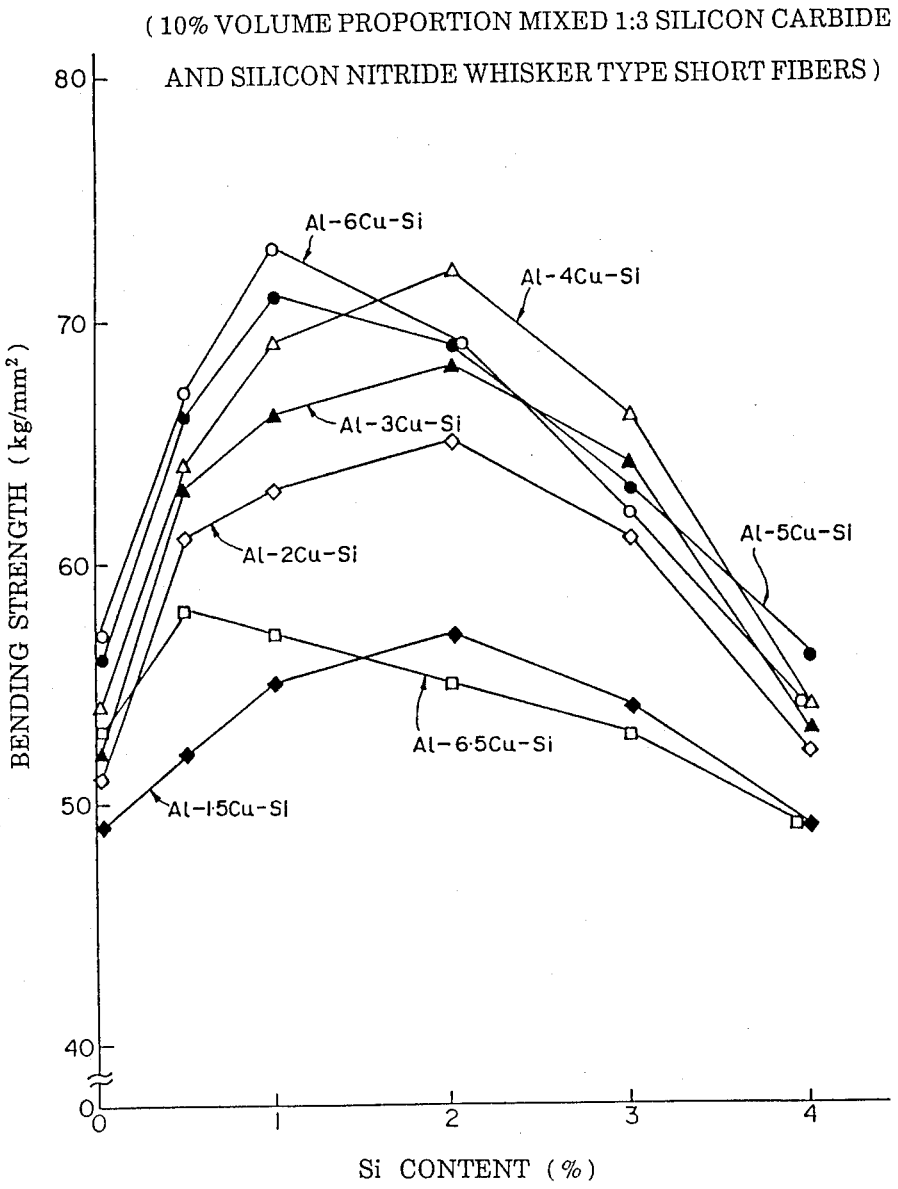
FIG. 17 is a set of graphs, similar to FIG. 3, FIGS. 5 and 6, FIG. 7, FIGS. 8 and 9, FIGS. 10 through 12, FIGS. 13 and 14, and FIGS. 15 and 16 for the first through the seventh sets of preferred embodiments respectively, in which again silicon content in percent is shown along the horizontal axis and bending strength in kg/mm$^2$ is shown along the vertical axis, derived from data relating to bending strength tests for the eighth set of preferred embodiments of the material of the present invention (in which the total volume proportion of reinforcing mixed silicon carbide and silicon nitride whisker type short fibers was now approximately 10%, and said silicon carbide and silicon nitride fibers were mixed approximately in a one to three ratio), each said graph similarly showing the relation between silicon content and bending strength of certain composite material test pieces for a particular fixed percentage content of copper in the matrix metal of the composite material.

The results of these bending strength tests were as summarized in the graphs of FIG. 17; thus, FIG. 17 corresponds to FIG. 3, FIGS. 5 and 6, FIG. 7, FIGS. 8 and 9, FIGS. 10 through 12, FIGS. 13 and 14, and FIGS. 15 and 16 respectively relating to the first, the second, the third, the fourth, the fifth, the sixth, and the seventh sets of preferred embodiments described above. In the graphs of FIG. 17, again there are shown relations between silicon content and the bending strength (in $kg/mm^2$) of certain of the composite material test pieces, for percentage contents of copper fixed along the various lines thereof.

From FIG. 17 it will be again similarly understood that, in this case that the volume proportion of the reinforcing mixed silicon carbide and silicon nitride whisker type short fiber material was approximately 10%, substantially irrespective of the silicon content of the aluminum alloy matrix metal of the bending strength composite material test pieces, when the copper content was either at the low extreme of approximately 1.5% or at the high extreme of approximately 6.5% the bending strength of the composite material had a relatively low value; and, contrariwise, when the copper content was between the more intermediate points of approximately 2% and approximately 6%, except in the extreme cases that the silicon content was approximately 0% or was approximately 4%, the bending strength of the composite material was considerably higher than when the copper content was either at the low extreme of approximately 1.5% or at the high extreme of approximately 6.5%. Accordingly, it will be understood that, again, it is considered to be preferable for the copper content to be between approximately 2% and approximately 6%. Further, it will be seen that, in this case that the volume proportion of the reinforcing mixed silicon carbide and silicon nitride whisker type short fiber material was approximately 10%, when the silicon content was between the more intermediate points of approximately 0.5% to approximately 3%, except in the extreme cases that the copper content was approximately 1.5% or was approximately 6.5%, the bending strength of the composite material was significantly greater than when the silicon content was either at the low extreme of approximately 0% or at the high extreme of approximately 4%. And, particularly in the case that the copper content had a relatively low value within the range of approximately 2% to approximately 4%, the bending strength of the composite material attained a substantially maximum value when the silicon content was approximately 2%. On the other hand, in the particular case that the copper content had a relatively high value within the range of approximately 5% to approximately 6%, the bending strength of the composite material attained a substantially maximum value when the silicon content was approximately 1%. Accordingly, it will be understood that, again, it is considered to be preferable for the silicon content to be between approximately 0.5% and approximately 3%.

It will be further seen that the values in FIG. 17 are generally much higher than the typical bending strength of approximately 48 kg/mm$^2$ attained in the conventional art for a composite material using as matrix metal a conventionally so utilized aluminum alloy of JIS standard AC4C and using a similar mixed silicon carbide and silicon nitride whisker type short type fiber material as reinforcing material in the similar fiber volume proportions of approximately 10%, with the relative proportions of silicon carbide and silicon nitride whisker type short type fiber material as specified above being about one to three. Further, it will be seen that, for the particular above described types of such composite material having fiber volume proportion approximately 10% of mixed silicon carbide and silicon nitride whisker type short fiber material as reinforcing fiber material and using an aluminum alloy as matrix metal with a copper content of from approximately 2% to approximately 6% and with a silicon content of from approximately 0.5% to approximately 3%, the bending strength value is between approximately 1.3 and approximately 1.5 times the abovementioned typical bending strength of approximately 48 kg/mm$^2$ attained by the above mentioned conventional composite material.

From the results of these bending strength tests it will be seen that, in order to provide for a good and appropriate bending strength for a composite material having as reinforcing fiber material mixed silicon carbide and silicon nitride whisker type short fibers in volume proportions of approximately 2.5% and approximately 7.5% each respectively, and having as matrix metal an Al-Cu-Si type aluminum alloy, again it is preferable that the copper content of said Al-Cu-Si type aluminum alloy matrix metal should be in the range of from approximately 2% to approximately 6% while the silicon content of said Al-Cu-Si type aluminum alloy matrix metal should be in the range of from approximately 0.5% to approximately 3%.

Comments On The Seventh And The Eighth Sets Of Preferred Embodiments

From the seventh and the eighth sets of preferred embodiments disclosed above, it will be understood that, in order to provide for a good and appropriate bending strength for a composite material having as reinforcing fiber material mixed silicon carbide and silicon nitride short fibers and having as matrix metal an Al-Cu-Si type aluminum alloy, irrespective of the volume proportion of said short fibers and of the relative proportions of the mix thereof, it is preferable that the copper content of said Al-Cu-Si type aluminum alloy matrix metal should be in the range of from approximately 2% to approximately 6% while the silicon content of said Al-Cu-Si type aluminum alloy matrix metal should be in the range of from approximately 0.5% to approximately 3%.

The Ninth Set Of Preferred Embodiments

Figure 18:
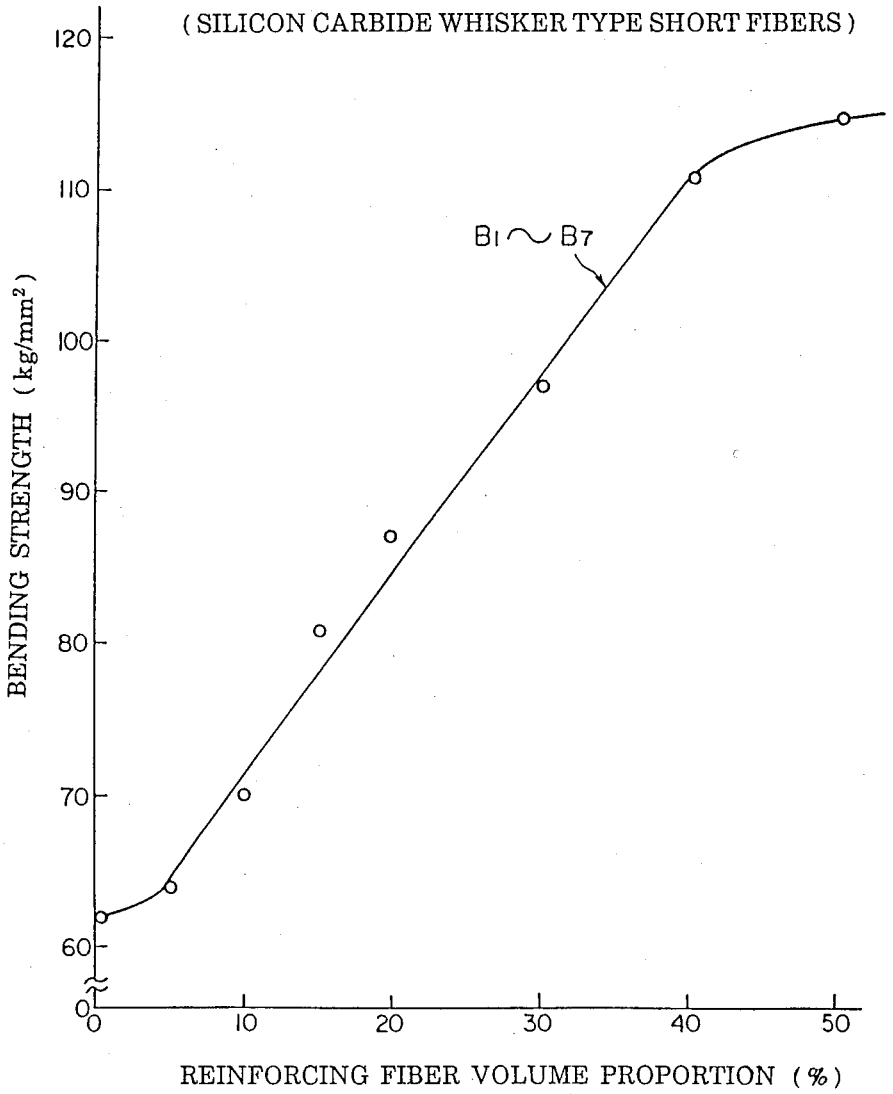
FIG. 18 is a graph relating to a first set of tests in which the fiber volume proportion of reinforcing silicon carbide short fiber material was varied, in which said reinforcing fiber volume in percent is shown along the horizontal axis and bending strength in kg/mm$^2$ is shown along the vertical axis, derived from data relating to bending strength tests for certain ones of a ninth set of preferred embodiments of the material of the present invention, said graph showing the relation between volume proportion of the reinforcing silicon carbide short fiber material and bending strength of certain test pieces of the composite material.
Figure 19:
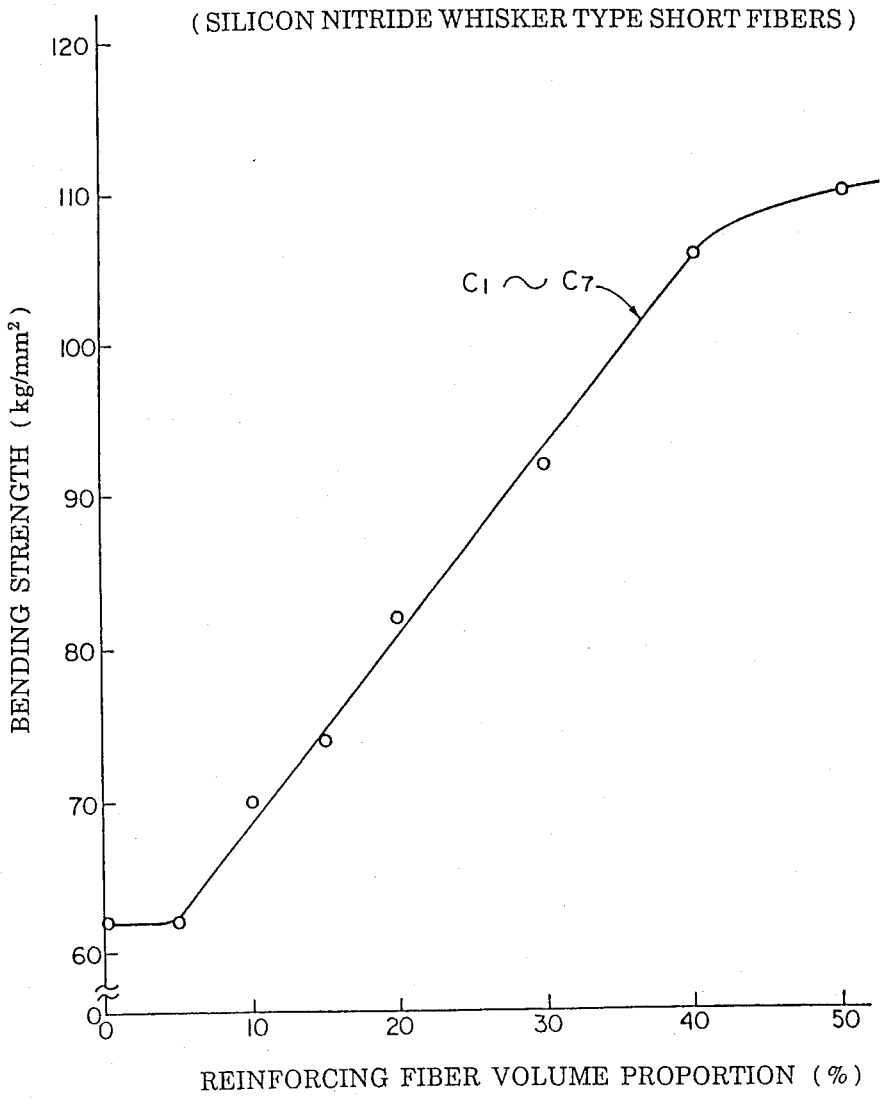
FIG. 19 is a graph, similar to FIG. 18 for said first set of tests, relating to a second set of tests in which the fiber volume proportion of reinforcing silicon nitride short fiber material was varied, in which said reinforcing fiber volume in percent is shown along the horizontal axis and bending strength in kg/mm$^2$ is shown along the vertical axis, derived from data relating to bending strength tests for certain other ones of said ninth set of preferred embodiments of the material of the present invention, said graph similarly showing the relation between volume proportion of the reinforcing silicon nitride short fiber material and bending strength of certain test pieces of the composite material.
Figure 20:
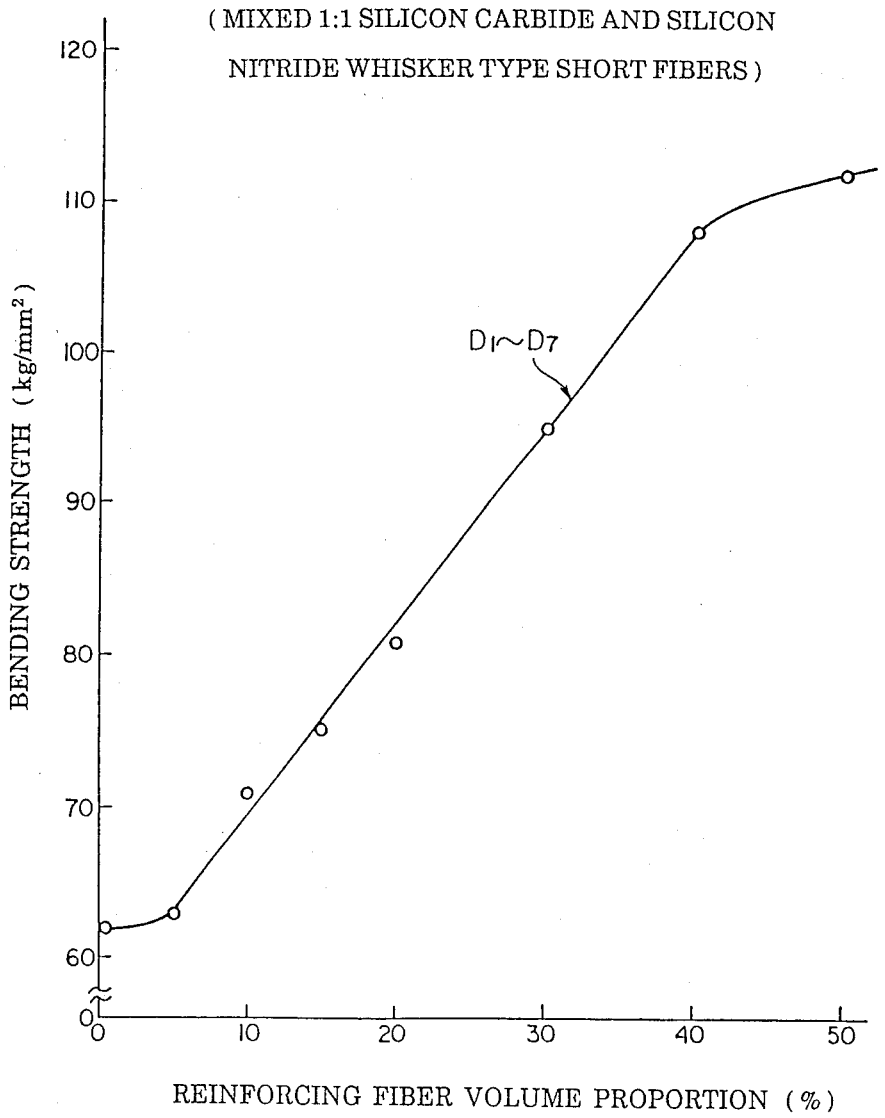
FIG. 20 is a graph, similar to FIGS. 18 and 19 for said first and second sets of tests, relating to a third set of tests in which the fiber volume proportion of reinforcing mixed silicon carbide and silicon nitride short fiber material was varied, in which said reinforcing fiber volume in percent is shown along the horizontal axis and bending strength in kg/mm$^2$ is shown along the vertical axis, derived from data relating to bending strength tests for certain further other ones of said ninth set of preferred embodiments of the material of the present invention, said graph again showing the relation between volume proportion of the reinforcing mixed silicon carbide and silicon nitride short fiber material and bending strength of certain test pieces of the composite material.

Since from the above described first through the eighth sets of preferred embodiments the fact has been amply established and demonstrated that it is preferable for the copper content of the Al-Cu-Si type aluminum alloy matrix metal to be in the range of from approximately 2% to approximately 6%, and that it is preferable that the silicon content of said Al-Cu-Si type aluminum alloy matrix metal should be in the range of from approximately 0.5% to approximately 3%, it next was deemed germane to provide a set of tests to establish what fiber volume proportion of the reinforcing silicon carbide short fibers, or silicon nitride short fibers, or mixed silicon carbide and silicon nitride short fibers, as the case may be, is most appropriate. This was done, in the ninth set of preferred embodiments now to be described, by varying said fiber volume proportion of the reinforcing mixed silicon carbide and/or silicon nitride whisker material while using an Al-Cu-Si type aluminum alloy matrix metal which had the proportions of copper and silicon which had as described above been established as being quite good, i.e. which had copper content of approximately 5% and also silicon content of approximately 1% and remainder substantially aluminum. In other words, an appropriate number (in fact seven in each case) of preforms made of silicon carbide and silicon nitride whisker material, hereinafter denoted respectively as B1 through B7, C1 through C7, and D1 through D7, were made by subjecting quantities of, respectively, the silicon carbide whisker material utilized in the case of the first set of preferred embodiments described above, the silicon nitride whisker material utilized in the case of the fifth set of preferred embodiments described above, and the evenly one to one mixed silicon carbide and silicon nitride whisker material utilized in the case of some of the seventh set of preferred embodiments described above, to compression forming without using any binder in the same manner as in the first set of preferred embodiments, the various ones in each set of said silicon carbide and/or silicon nitride whisker material preforms having fiber volume proportions of approximately 5%, 10%, 15%, 20%, 30%, 40%, and 50%. These preforms had substantially the same dimensions and the same type of three dimensional random fiber orientation as the preforms of the first set of preferred embodiments. And, substantially as before, each of these silicon carbide and/or silicon nitride whisker material preforms was subjected to high pressure casting together with an appropriate quantity of one of the aluminum alloy matrix metals described above, utilizing operational parameters substantially as before. In each case, the solidified aluminum alloy mass with the preform included therein was then removed from the casting mold, and as before the peripheral portion of said solidified aluminum alloy mass was machined away, leaving only a sample piece of composite material which had silicon carbide and/or silicon nitride fiber whisker material as reinforcing material in the appropriate fiber volume proportion and the described aluminum alloy as matrix metal. And post processing steps were performed on the composite material samples, similarly to what was done before: the composite material samples were subjected to liquidizing processing at a temperature of approximately 480° C. for approximately 8 hours, and then were subjected to artificial aging processing at a temperature of approximately 160° C. for approximately 8 hours. From each of the composite material sample pieces manufactured as described above, to which heat treatment had been applied, there was then cut a bending strength test piece, each of dimensions substantially as in the case of the first set of preferred embodiments, and for each of these composite material bending strength test pieces a bending strength test was carried out, again substantially as before. The results of these bending strength tests were as shown in the graphs of FIGS. 18, 19, and 20, respectively for the silicon carbide whisker reinforcing fiber material, the silicon nitride whisker reinforcing fiber material, and the evenly one to one mixed silicon carbide and silicon nitride whisker reinforcing fiber material. Each of these graphs shows the relation between the volume proportion of the silicon carbide and/or silicon nitride whisker type short reinforcing fibers and the bending strength (in kg/mm$^2$) of the composite material test pieces, for the appropriate type of reinforcing fibers.

From FIGS. 18 through 20, it will be understood that: when the volume proportion of the silicon carbide and/or silicon nitride short reinforcing fibers was in the range of up to and including approximately 5% the bending strength of the composite material hardly increased along with an increase in the fiber volume proportion, and its value was close to the bending strength of the aluminum alloy matrix metal by itself with no reinforcing fiber material admixtured therewith; when the volume proportion of the silicon carbide and/or silicon nitride short reinforcing fibers was in the range of 5% to 40% the bending strength of the composite material increased greatly, and substantially linearly along with increasing fiber volume proportion; and, when the volume proportion of the silicon carbide and/or silicon nitride short reinforcing fibers increased above 40%, the bending strength of the composite material did not increase very much even with further increase in the fiber volume proportion. From these results described above, it is seen that in a composite material having silicon carbide and/or silicon nitride short fiber reinforcing material and having as matrix metal an Al-Cu-Si type aluminum alloy, said Al-Cu-Si type aluminum alloy matrix metal having a copper content in the range of from approximately 2% to approximately 6%, a silicon content in the range of from approximately 0% to approximately 2%, and remainder substantially aluminum, it is preferable that the fiber volume proportion of the silicon carbide and/or silicon nitride short fiber reinforcing material should be in the range of from approximately 5% to approximately 50%, and more preferably should be in the range of from approximately 5% to approximately 40%.

Although the present invention has been shown and described in terms of the preferred embodiments thereof, and with reference to the appended drawings, it should not be considered as being particularly limited thereby, since the details of any particular embodiment, or of the drawings, could be varied without, in many cases, departing from the ambit of the present invention. Accordingly, the scope of the present invention is to be considered as being delimited, not by any particular perhaps entirely fortuitous details of the disclosed preferred embodiments, or of the drawings, but solely by the scope of the accompanying claims, which follow after the Table.

TABLE

| ALLOY NO. | COPPER CONTENT (WT %) | SILICON CONTENT (WT %) |
|---|---|---|
| A1 | 1.52 | 0.04 |
| A2 | 1.50 | 0.53 |
| A3 | 1.49 | 1.01 |

TABLE-continued

| ALLOY NO. | COPPER CONTENT (WT %) | SILICON CONTENT (WT %) |
|---|---|---|
| A4 | 1.46 | 2.03 |
| A5 | 1.46 | 2.99 |
| A6 | 1.45 | 3.97 |
| A7 | 2.03 | 0.02 |
| A8 | 2.02 | 0.51 |
| A9 | 2.00 | 1.04 |
| A10 | 1.99 | 2.04 |
| A11 | 1.97 | 3.01 |
| A12 | 1.96 | 3.96 |
| A13 | 3.01 | 0.03 |
| A14 | 3.01 | 0.50 |
| A15 | 3.00 | 1.01 |
| A16 | 2.98 | 2.02 |
| A17 | 2.97 | 2.98 |
| A18 | 2.95 | 4.01 |
| A19 | 4.04 | 0.03 |
| A20 | 4.03 | 0.54 |
| A21 | 4.01 | 1.02 |
| A22 | 3.99 | 2.03 |
| A23 | 3.98 | 3.01 |
| A24 | 3.96 | 3.99 |
| A25 | 5.03 | 0.04 |
| A26 | 5.03 | 0.50 |
| A27 | 5.00 | 0.98 |
| A28 | 4.99 | 1.98 |
| A29 | 4.97 | 2.96 |
| A30 | 4.95 | 3.96 |
| A31 | 6.02 | 0.04 |
| A32 | 6.02 | 0.47 |
| A33 | 6.00 | 1.00 |
| A42 | 5.97 | 2.02 |
| A35 | 5.97 | 3.01 |
| A36 | 5.97 | 3.99 |
| A37 | 6.51 | 0.04 |
| A38 | 6.50 | 0.52 |
| A39 | 6.49 | 0.96 |
| A40 | 6.48 | 1.97 |
| A41 | 6.46 | 2.99 |
| A42 | 6.45 | 4.01 |

What is claimed is:

1. A composite material, comprising short fibers, the material of each one of which is selected from the class made up of silicon carbide and silicon nitride, embedded in a matrix of metal, said metal being an alloy consisting essentially of between approximately 2% to approximately 6% of copper, between approximately 0.5% to approximately 3% of silicon, and remainder substantially aluminum.

2. A composite material according to claim 1, wherein substantially all said short fibers are composed of silicon carbide.

3. A composite material according to claim 1, wherein substantially all said short fibers are composed of silicon nitride.

4. A composite material according to claim 1, wherein a substantial proportion of said short fibers are composed of silicon carbide and a substantial proportion of said short fibers are composed of silicon nitride.

5. A composite material according to claim 1, wherein the fiber volume proportion of said short fibers is between approximately 5% and approximately 50%.

6. A composite material according to claim 1, wherein the fiber volume proportion of said short fibers is between approximately 5% and approximately 40%.

* * * * *